United States Patent [19]

Oka et al.

[11] Patent Number: 5,072,945

[45] Date of Patent: Dec. 17, 1991

[54] GOLF BALL

[75] Inventors: Kengo Oka, Kobe; Yoshikazu Yabuki, Akashi, both of Japan

[73] Assignee: Sumitomo Rubber Industries, Ltd., Hyogo, Japan

[21] Appl. No.: 581,547

[22] Filed: Sep. 12, 1990

[30] Foreign Application Priority Data

Jul. 2, 1990 [JP] Japan ..... 2-175970

[51] Int. Cl.[5] ..... A63B 37/12

[52] U.S. Cl. ..... 273/232; 40/327

[58] Field of Search ..... 273/232, 235 R, 235 A, 273/235 B, 213; 40/327

[56] References Cited

U.S. PATENT DOCUMENTS 4,744,564 5/1988 Yamada ..... 273/232

4,813,677 3/1989 Oka et al. ..... 273/232

4,880,241 11/1989 Melvin et al. ..... 273/232

*Primary Examiner*—George J. Marlo

[57] ABSTRACT

A golf ball having a spherical surface with a great circle zone along a parting line, the surface being divided by a central angle $\theta$ of the sphere of $10° \leqq \theta < 60$ above and below the parting line to form a central S region and a polar P region. A plurality of kinds of dimples are arranged in both the S region, $SD_n$, and the P region, $PD_n$, the dimples of each region being geometrically symmetric about the parting line. The curvatures diameters, depths and volumes of the dimples within a region differ between kinds of dimples. At least one type of dimple in the S region has a corresponding type of dimple in the P region, the correspondence being equal curvature. The value of the volumes of the corresponding pairs of dimples are set such that $1.0223$ $VSD_n/VPD_n \leqq 1.25$.

4 Claims, 34 Drawing Sheets

GOLF BALL

BACKGROUND OF THE INVENTION

1. Field of the Invention

The present invention relates to a golf ball, and more particularly, to the golf ball having an improved arrangement of dimples to be formed on the surface of the golf ball and a novel volume ratio between dimples corresponding to the regions thereof so as to improve the symmetricalness of the golf ball.

2. Description of the Related Arts

Normally, 300 to 550 dimples in number are formed on the surface of a golf ball. The principal role of dimples is to improve the aerodynamic characteristic thereof while the golf ball is flying, to optimize the trajectory, and to increase the carry or flying distance thereof.

In order to improve the aerodynamic characteristic of the golf ball, as disclosed in Oka et al., U.S. Pat. No. 4,813,677, it is preferable to form dimples densely on the surface thereof and reduce the number of great circle zones which intersect no dimples.

However, one great circle zone is inevitably formed on the surface of the golf ball. The golf ball is normally molded by a split metallic mold composed of semi-spherical upper and lower molds, a burr is formed at the junction of the molds, i.e. at a parting line between the upper and lower molds during the molding. Such burr is to be scraped off in a later processing by buffing to form a seam thereat, and therefore, the dimples can not be provided on the seam to facilitate buffing of the burr. In result, the golf ball has on its spherical surface a great circle zone which intersect no dimples even though dimples are densely formed thereon.

The great circle zone presents the aerodynamic characteristic clearly different from that of spherical surfaces of other golf ball having dimples densely formed thereon. That is, the great circle zone causes the following two problems. The first problem is the unsymmetricalness of the golf ball during its flight. The second problem is a putted golf ball does not roll straight.

It is preferable that the golf ball flies in the same trajectory wherever a golf club hits the golf ball. But the great circle zone differentiates the effect of dimples arranged in the vicinity of the great circle zone and the effect of dimples densely arranged in the vicinity of the poles from each other. Thus, the trajectory height in a seam hitting differs from that in a pole hitting. In a seam hitting, i.e., when the golf ball is struck in such a manner that the line connecting both poles serves as the rotational axis of a back-spin thereof, the portion where the circumferential speed of the rotary axis is the fastest coincides with the seam, thus undesirably lowering the trajectory height as compared with that when another line is set to be the rotary axis. The reason is that since, in the seam hitting, the circumference which is rotated fastest coincided with the parting line, the dimple effect of the golf ball on the whole is decreased to prevent the generation of the lift. The pole hitting means that the golf ball is struck in such a manner that a line perpendicular to the above-described rotational axis serves as the rotational axis of the back-spin thereof.

It is preferable that the golf ball follows along the same line on the green supposing that it is putted by a putter in the same manner or by the same force. But the great circle zone does not allow the golf ball to roll forward straight when it is putted by the putter in such a manner that the line connecting both poles thereof serves as the rotational axis of an over-spin. That is, as shown in FIG. 18, the parting line L of a golf ball 1 and portions in the vicinity thereof contact the green. The configuration of a dimple 2 positioned in the left of the seam L is different from that of the dimple 2 positioned in the right. Therefore, the extent of force applied to the golf ball from the left is different from that of force applied thereto from the right. Thus, the golf ball turns to the left or the right, thereby resulting in an unfavorable directivity, namely, an undesired rolling to the left or the right not along a targeted line. This is a trouble to golf players considering that many golf players putt the golf ball with the parting line L aligning with a putting line.

In order to overcome the previously described unsymmetricalness of the golf ball during its flights, namely the trajectory height in the seam hitting differs from that in the pole hitting, Yamada, U.S. Pat. No. 4,744,564 discloses the following technique. That is, the volumes of dimples arranged in the vicinity of the seam are larger than those of dimples arranged in the vicinity of the poles so as to improve the dimple effect in the vicinity of the seam, namely, to equalize trajectory height in the seam hitting to that in the pole hitting.

However, this art is incapable of solving the second problem, referred to previously, that a putted golf ball turns to the left or the right.

SUMMARY OF THE INVENTION

The present invention has been made to solve the above-described problems of a golf ball having a great circle zone intersecting no dimples and formed on a parting line. It is therefore an object of the present invention to eliminate the difference in trajectory heights between a seam hitting and a pole hitting. This object is accomplished by reducing the difference between the dimple effect of the region, in the vicinity of the great circle zone and including the great circle zone, having no dimples formed thereon and the dimple effect of the region, in the vicinity of both poles, having dimples densely formed thereon.

It is another object of the present invention to prevent a putted golf ball from being turned to the left or the right. This object is achieved by arranging dimples symmetrically with respect to the face including the parting line.

In order to achieve the above-described objects, a golf ball according to the present invention has dimples formed thereon and a great circle zone intersecting no dimples exists on a parting line. In this construction, a region less than 60° from a parting line of the golf ball by a central angle of the sphere is each represented as S region, another region from more than 60° to a pole is each represented as a P region, a volume of one dimple located within said S region is represented as VS, and a volume of another dimple having a curvature equal to that of said one dimple and located within said P region is represented as VP, the volumes of the dimples in said S region and P region are determined so that the volume ratio of VS/VP is set as:

$$1.02 \leqq VS/VP \leqq 1.25.$$

The present invention has another feature that dimples formed by a pair of semi-spherical split molds are arranged symmetrically with respect to the face including the parting line.

The central angle $\theta$ of the golf ball, namely. the angle which separates S region from P region is preferably: $10° \leqq \theta < 60°$, although an optimum value is determined according to a dimple arrangement.(Said central angle is regarded as latitude, when the seam is regarded as equator.)

The dimple arranged within the S region means that the center of the dimple is positioned in the S region and similarly, the dimple arranged within the P region means that the center of the dimple is positioned in the P region.

According to the golf ball of the present invention, since the dimple effect between one region and the other region is reduced by setting the value of VS/VP as described above, the difference in the trajectory height depending on the portions struck by club, namely the trajectory height between the pole hitting and the seam hitting can be reduced. Further, since dimples are arranged symmetrically with respect to the face including the parting line, the golf ball does not deviate from a targeted putting line to a great extent.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

The embodiments of the present invention will be described with reference to the accompanying drawings.

Figure 1:
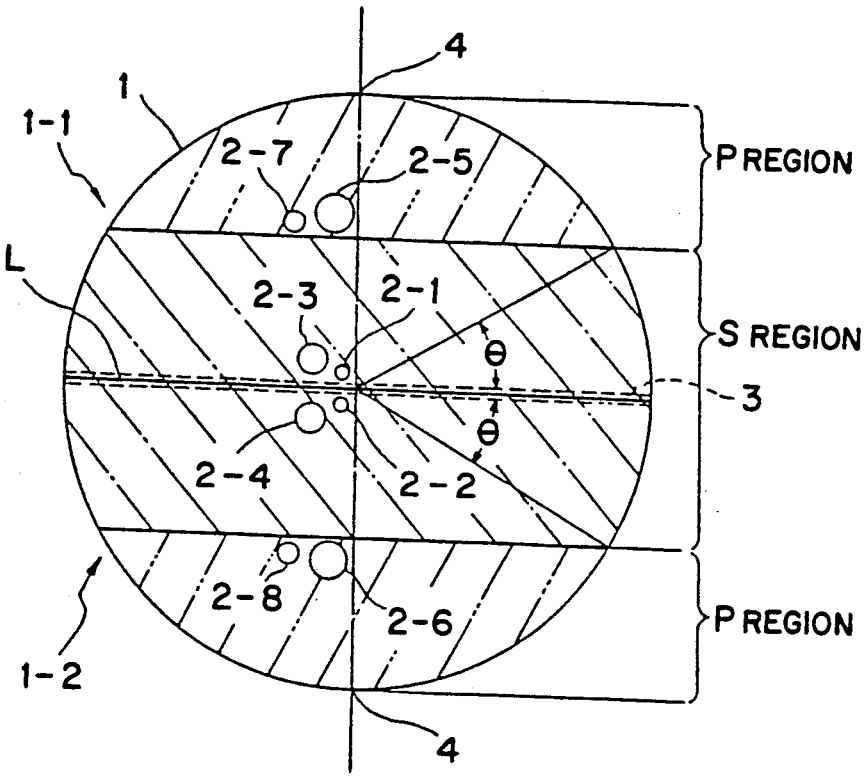
FIG. 1 is a schematic view showing a golf ball having spherical surface divided into S region and P region.

Referring to FIG. 1 showing schematically the construction of a golf ball 1 in accordance with the present invention, the golf ball 1 has a plurality of dimples 2 formed thereon, the diameters of which differ from each other. Only eight dimples 2-1 ~2-8 are shown in FIG. 1. Each of the dimples 2 forms a part of a spherical surface each having a certain curvature.

A great circle zone 3 intersecting no dimples 2 is formed on the seam (parting line L) of the golf ball 1. No other great circle zones are formed on the golf ball 1.

Similarly to a conventional golf ball, the golf ball 1 is formed by semi-spherical upper and lower molds. That is, the upper semi-sphere 1-1 of the golf ball 1 molded by the upper mold and the semi-sphere 1-2 thereof molded by the lower mold are joined with each other at the parting line L corresponding to the mating line of the upper and lower molds. A burr formed along the parting line L in molding the golf ball 1 is polished off the golf ball 1 in a subsequent process. Therefore, no dimples are formed on the parting line L to facilitate the polish-off of the burr. As described previously, the golf ball 1 has the great circle zone 3 formed on the seam (parting line L).

Dimples are configured and arranged on the surface of the golf ball 1 so that the dimple 2 formed on the upper semi-sphere 1-1 molded by the upper mold and the dimple 2 formed on the lower semi-sphere 1-2 molded by the lower mold are symmetrical with respect to the face including the parting line L. That is, referring to FIG. 1, a dimple 2-1 and a dimple 2-2 symmetrical with respect to the parting line L are molded to have the same configuration. Similarly, a dimple 2-3 and a dimple 2-4, a dimple 2-5 and a dimple 2-6, a dimple 2-7 and a dimple 2-8 each symmetrical with respect to the parting line L are molded to have the same configuration, respectively. Similarly, other dimples are configured and arranged on the surface of the golf ball 1 so that they are symmetrical with respect to the face including the parting line L.

Referring to FIG. 1, the spherical surface of the golf ball is divided into an S region as shown by one-dot chain lines and a P region as shown by two-dot chain lines. The S region ranges from the parting line L to each of two circumferences formed in correspondence with a central angle of less than 30° with respect to the parting line L and includes the great circle zone 3 on the parting line L. The P region ranges from the above-described circumferences to each of the poles 4. The dimples (2-1 ~ 2-4) arrange within the S region and the dimples (2-5 ~ 2-8) arranged within the P region having the same curvature are altered in volume for differentiation from each other. For example, the dimples 2-1 and 2-7 having the same curvature are varied in volume.

Supposing that the volume of a dimple arranged within the S region is represented as VS, the volume of a dimple having the same curvature as that of the above-described dimple and arranged within the P region is represented as VP, the volume ratio of VS/VP is set as follows:

$$1.02 \leqq VS/VP \leqq 1.25$$

The settings as described above have been obtained from results of various experiments, and mainly in consideration of the ratio of total area of the dimples to the surface area of the golf ball. That is, the greater the ratio of total area of the dimples is and the more dimples are arranged closely on the surface of the golf ball, the greater the difference between the dimple effect of the S region including the great circle zone having no dimples formed thereon and the dimple effect of the P region having dimples densely formed thereon becomes. Conversely, the smaller the ratio of total area of the dimples to the surface area of the golf ball is, the smaller the difference between the dimple effect of the S region and the P region becomes. Accordingly, when the surface area occupying rate by the dimples is small, preferably, VS/VP is 1.02 or more. On the other hand, when the surface area occupying rate by the dimples is large, preferably, VS/VP is 1.25 or less.

More specifically, the ratio of the volume of the dimple 2-1 arranged in the S region to the volume of the dimple 2-7 arranged in the P region and having the same curvature as that of the dimple 2-1 is set to be 1.02 or more and 1.25 or less. Similarly, the ratio of the volume of the dimple 2-3 arranged in the S region to the volume of the dimple 2-5 arranged in the P region and having the same curvature as that of the dimple 2-3 is also set to be 1.02 or more and 1.25 or less.

In the example shown in FIG. 1, the central angle $\theta$ namely, the angle which separates the S region from the P region is 30°, but the central angle can be appropriately selected in the range from 10° to 60° depending on a dimple arrangement. The reason is as follows: If the central angle is less than 10°, the number of dimples to be arranged in the S region is very few. Thus, there is no meaning in differentiating dimple volumes. If the central angle is more than 60°, the dimple effect of the S region becomes larger than the dimple effect in the P region. Consequently, compared with the pole hitting, the trajectory height in the seam hitting increases.

Figure 2A:
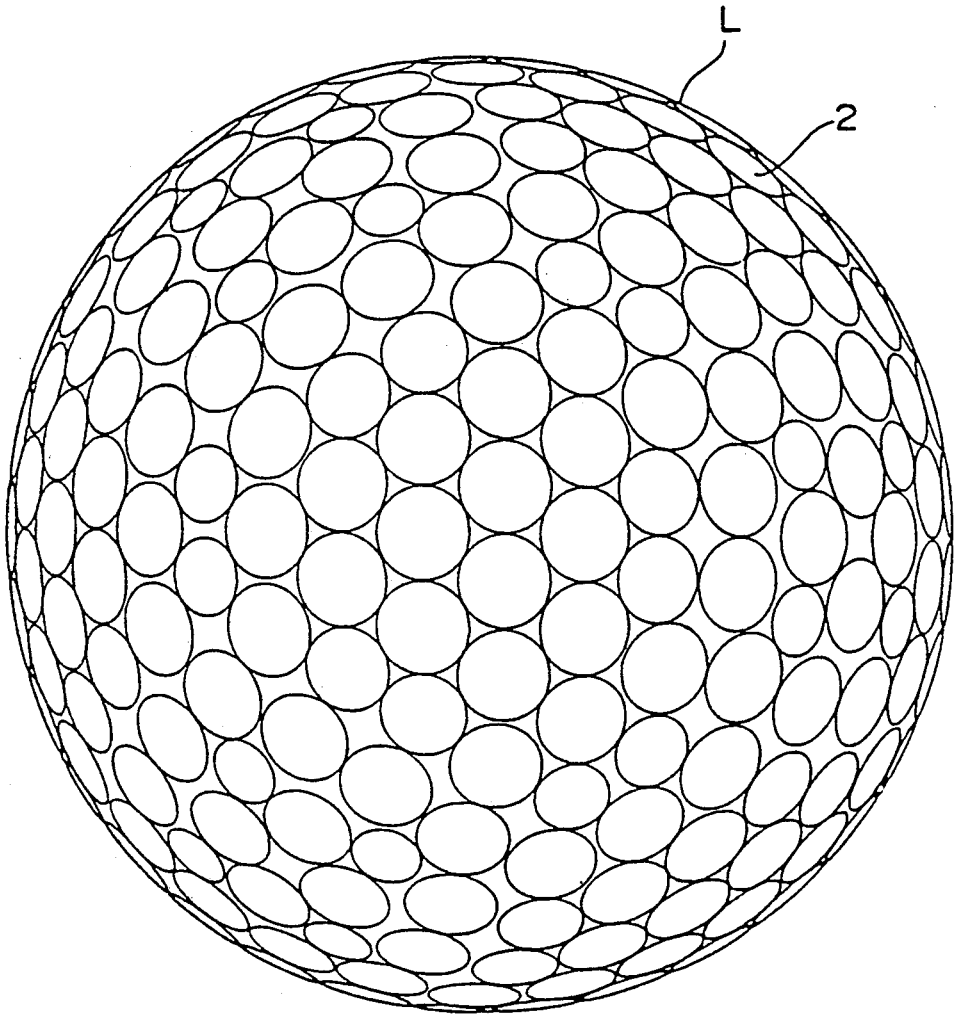
FIG. 2A is a front view showing a golf ball, according to a first embodiment of the present invention, viewed in a pole direction.
Figure 2B:
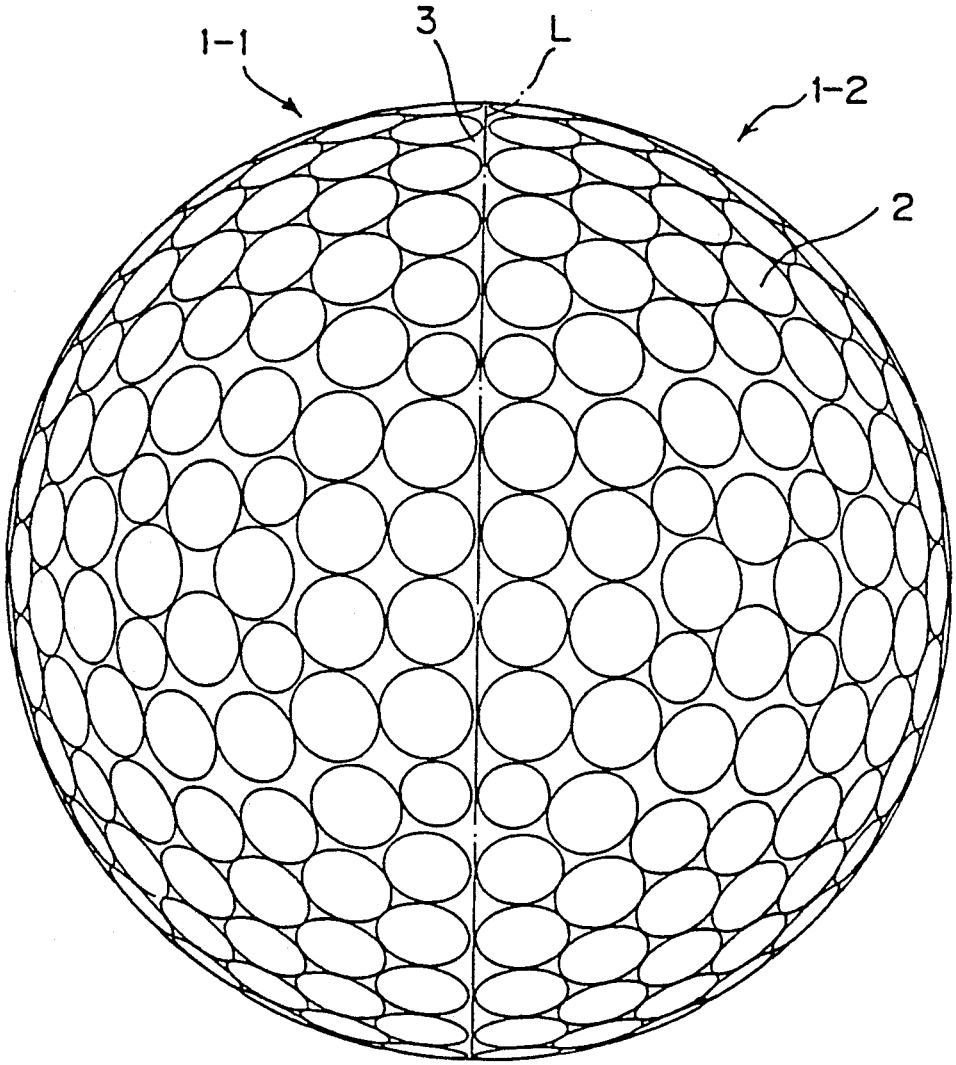
FIG. 2B is a side elevational view showing the golf ball, according to the first embodiment of the present invention, viewed in a parting line direction.
Figure 2C:
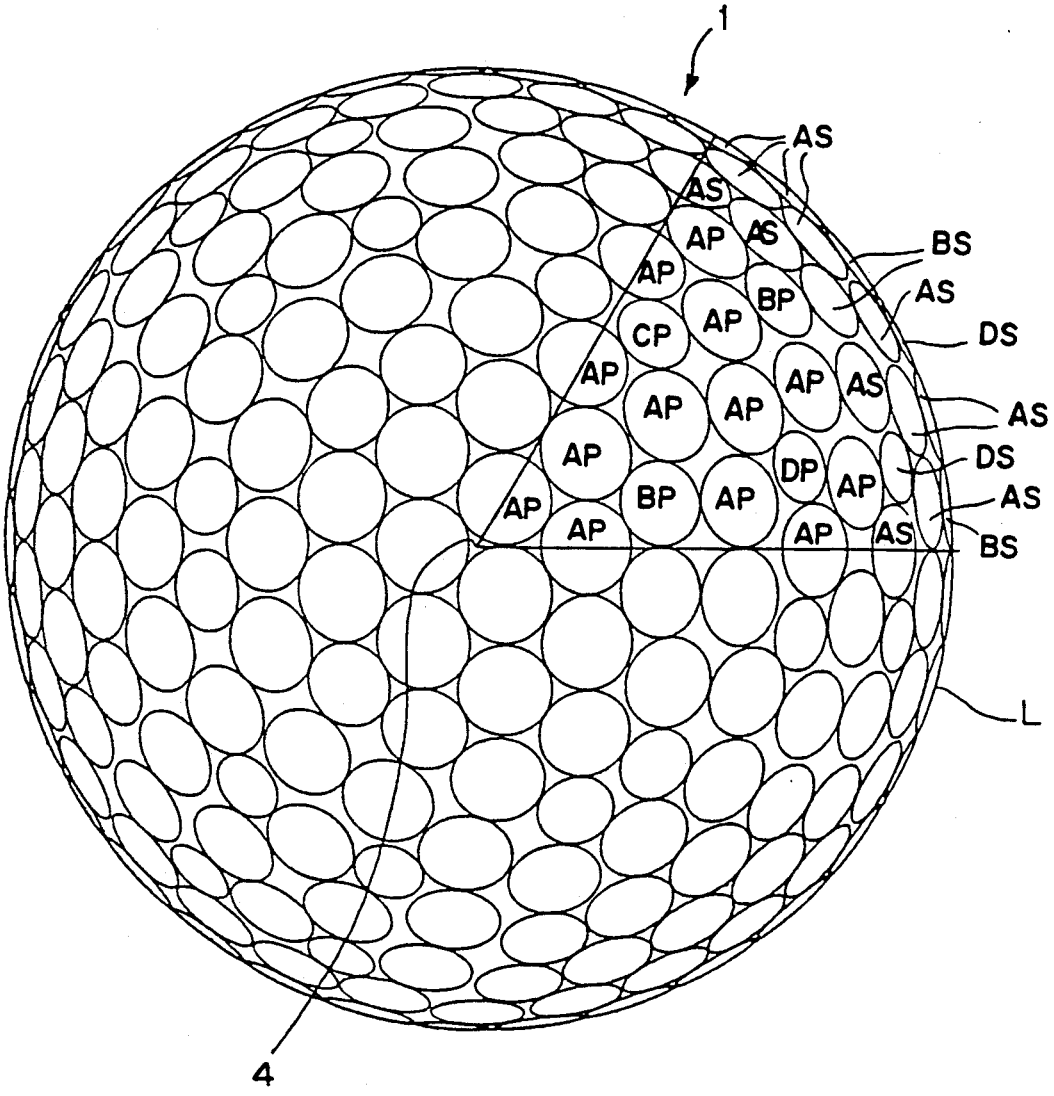
FIG. 2C is a view similar to FIG. 2A which particularly shows arrangement of dimples according to kinds thereof.

FIGS. 2A, 2B, and 2C show a golf ball according to a first embodiment of the present invention. FIG. 2A is a front view in which the golf ball is viewed in a pole direction. FIG. 2B is a right side elevational view in which the golf ball is viewed in the parting line direction. FIG. 2C is a view similar to FIG. 2A which particularly shows arrangement of dimples according to kinds thereof. The golf ball 1 has 360 dimples formed thereon. The central angle $\theta$ for dividing the spherical surface thereof into the S region and the P region is 30°. Both the S region and the P region have four kinds of dimples A, B, C, and D different from each other in the curvatures, diameters, depths, and volumes thereof. As shown in FIG. 2C, the dimples 2 arranged within the S region comprises dimples AS, BS, and DS. The dimples 2 arranged within the P region comprises dimples AP, BP, CP, and DP. The volume ratio of the dimple AS to AP having the same curvature as AS, similarly BS to BP, CS to CP, and DS to DP, are each 1.08. Specifications of the dimples are shown in Table 1 below.

As shown in FIG. 2B, dimples arranged in two semi-spheres 1-1 and 1-2 are symmetrical with respect to the face including the parting line L.

Figure 3A:
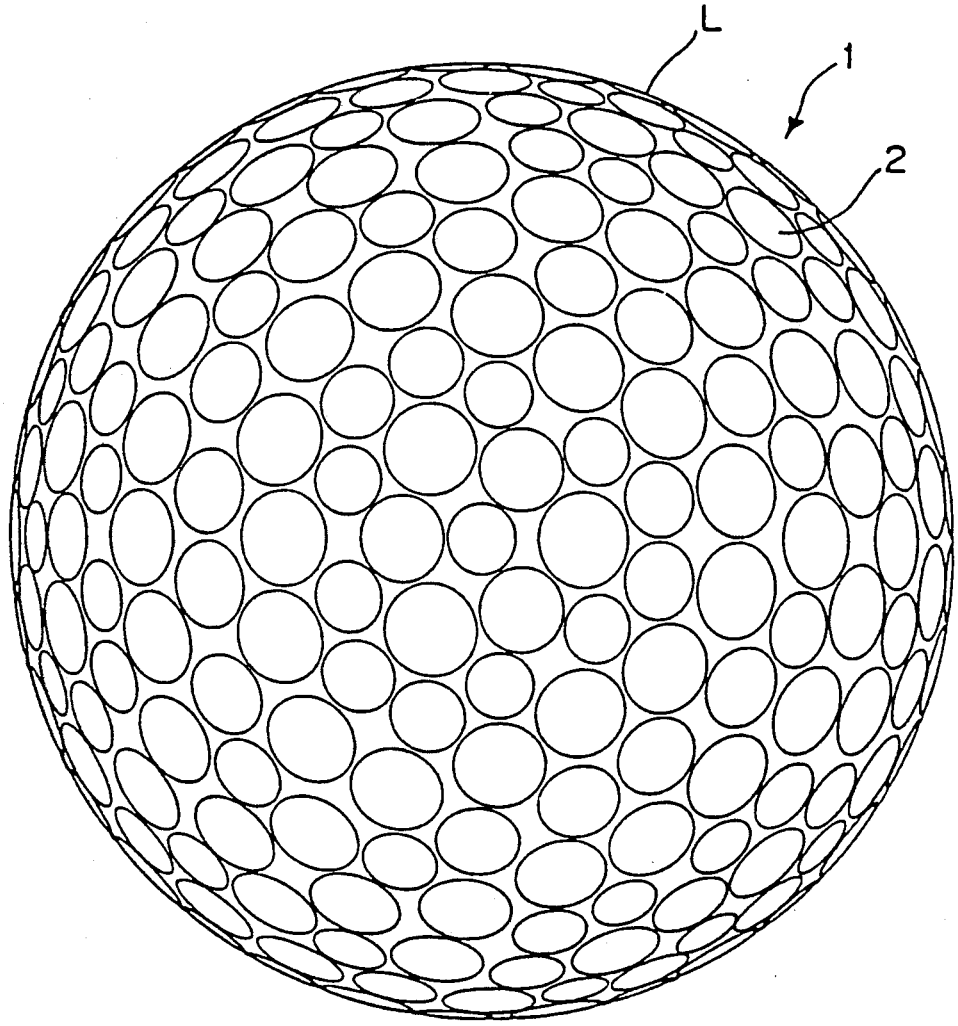
FIG. 3A is a front view showing a golf ball, according to a second embodiment of the present invention, viewed in a pole direction.
Figure 3B:
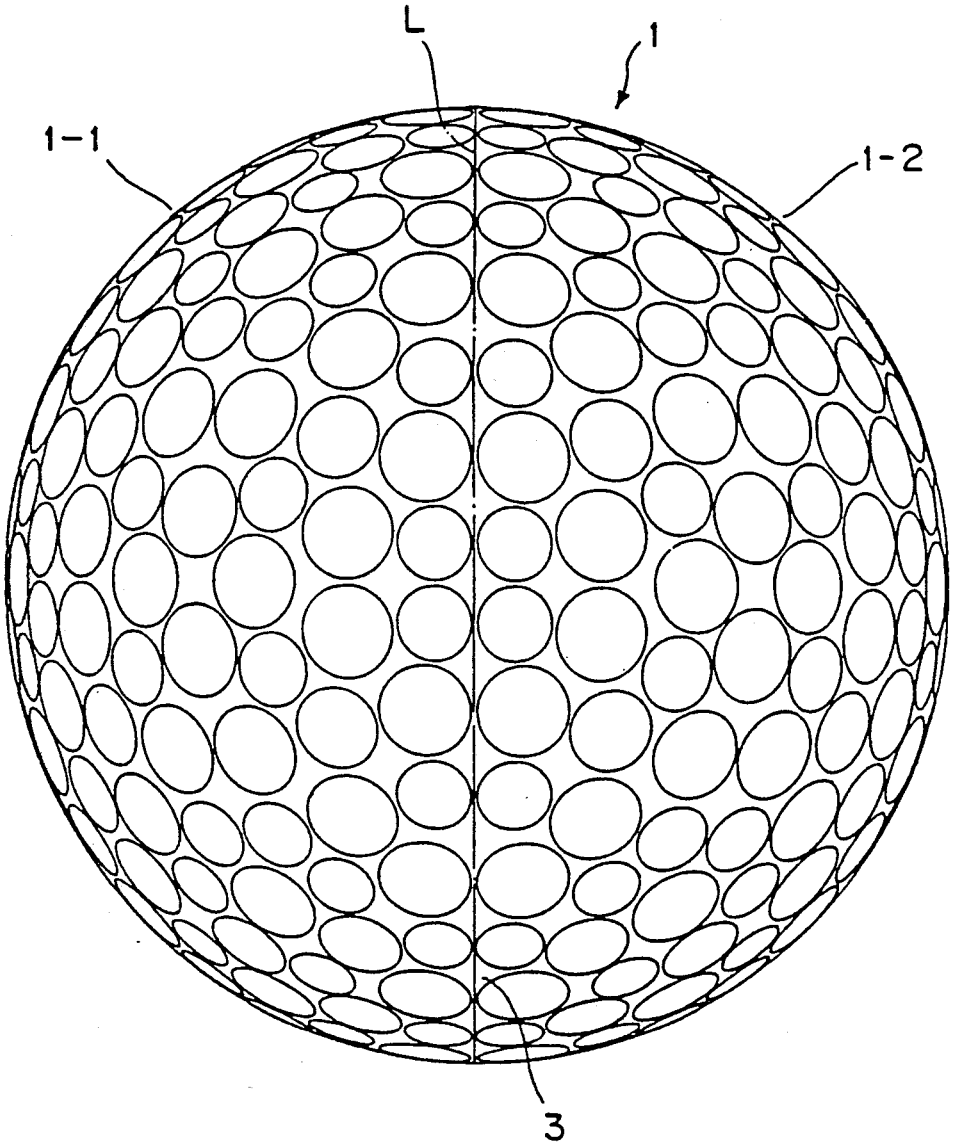
FIG. 3B is a side elevational view showing the golf ball, according to the second embodiment of the present invention, viewed in a parting line direction.
Figure 3C:
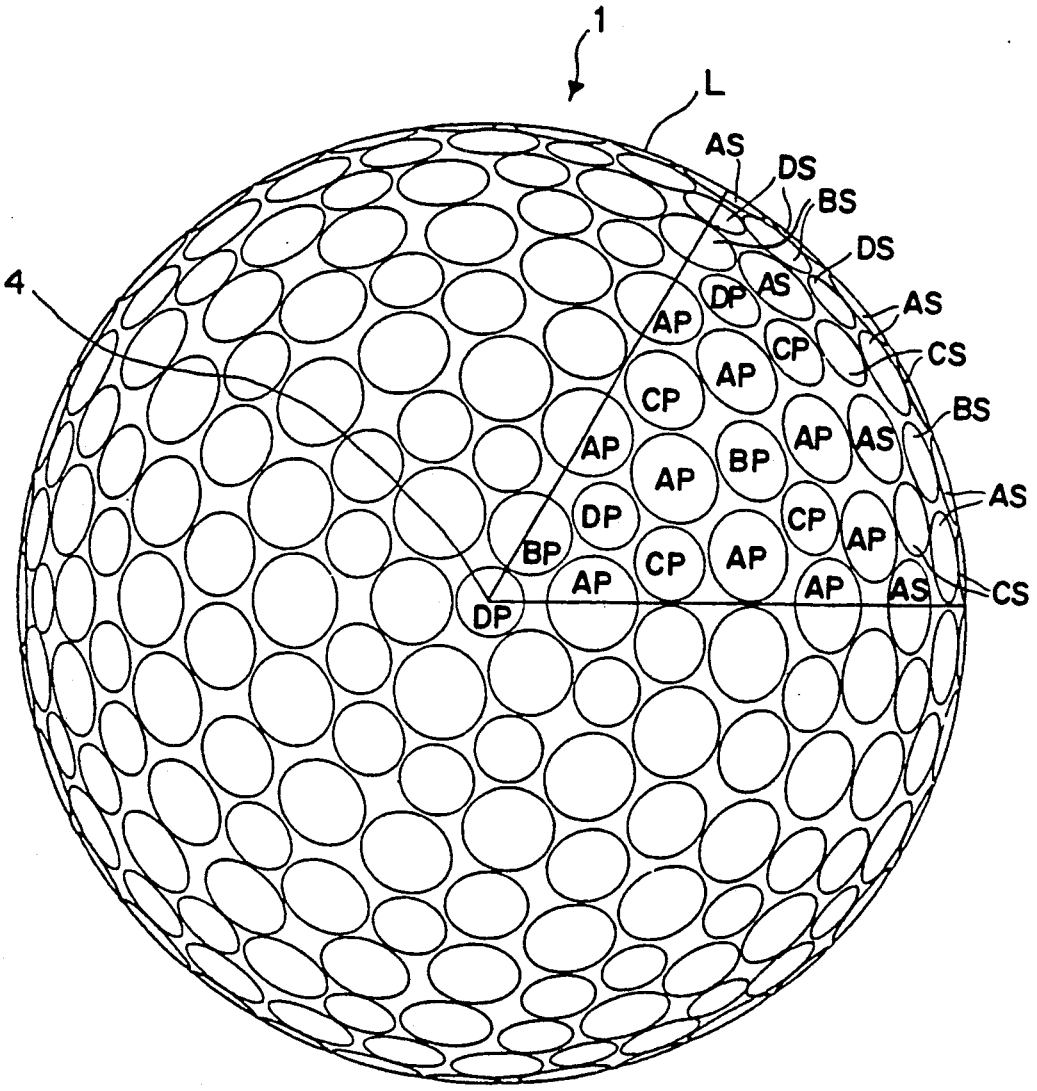
FIG. 3C is a view similar to FIG. 3A which particularly shows arrangement of dimples according to kinds thereof.
Figure 4A:
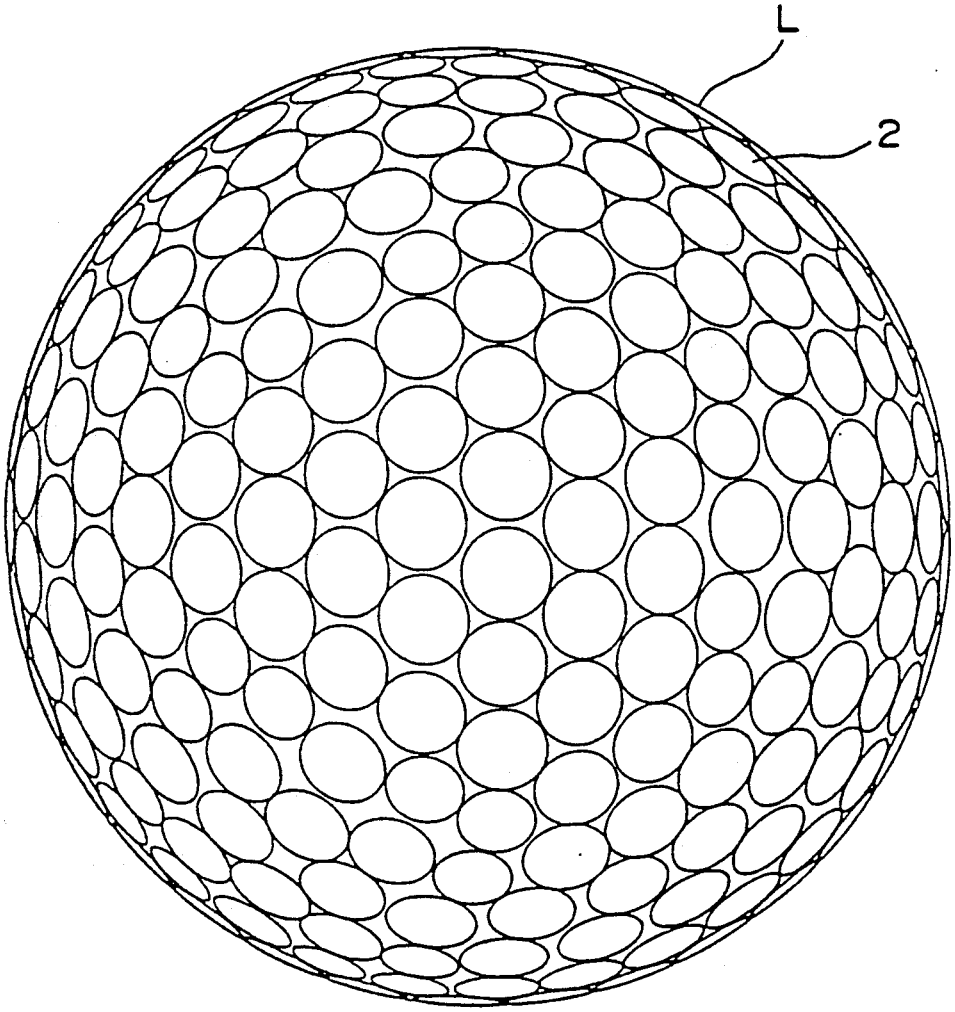
FIG. 4A is a front view showing a golf ball, according to a third embodiment of the present invention, viewed in a pole direction.
Figure 4B:
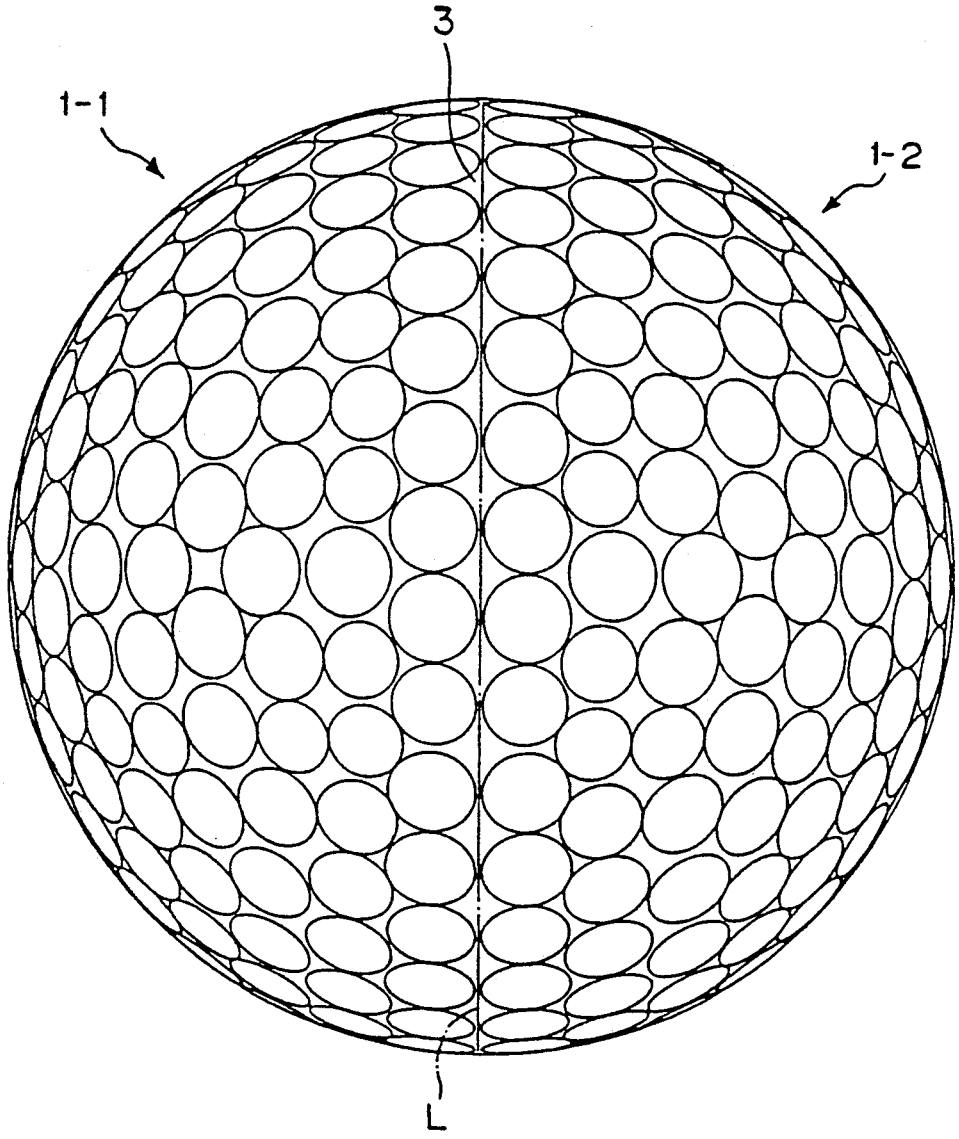
FIG. 4B is a side elevational view showing the golf ball, according to the third embodiment of the present invention, viewed in a parting line direction.
Figure 4C:
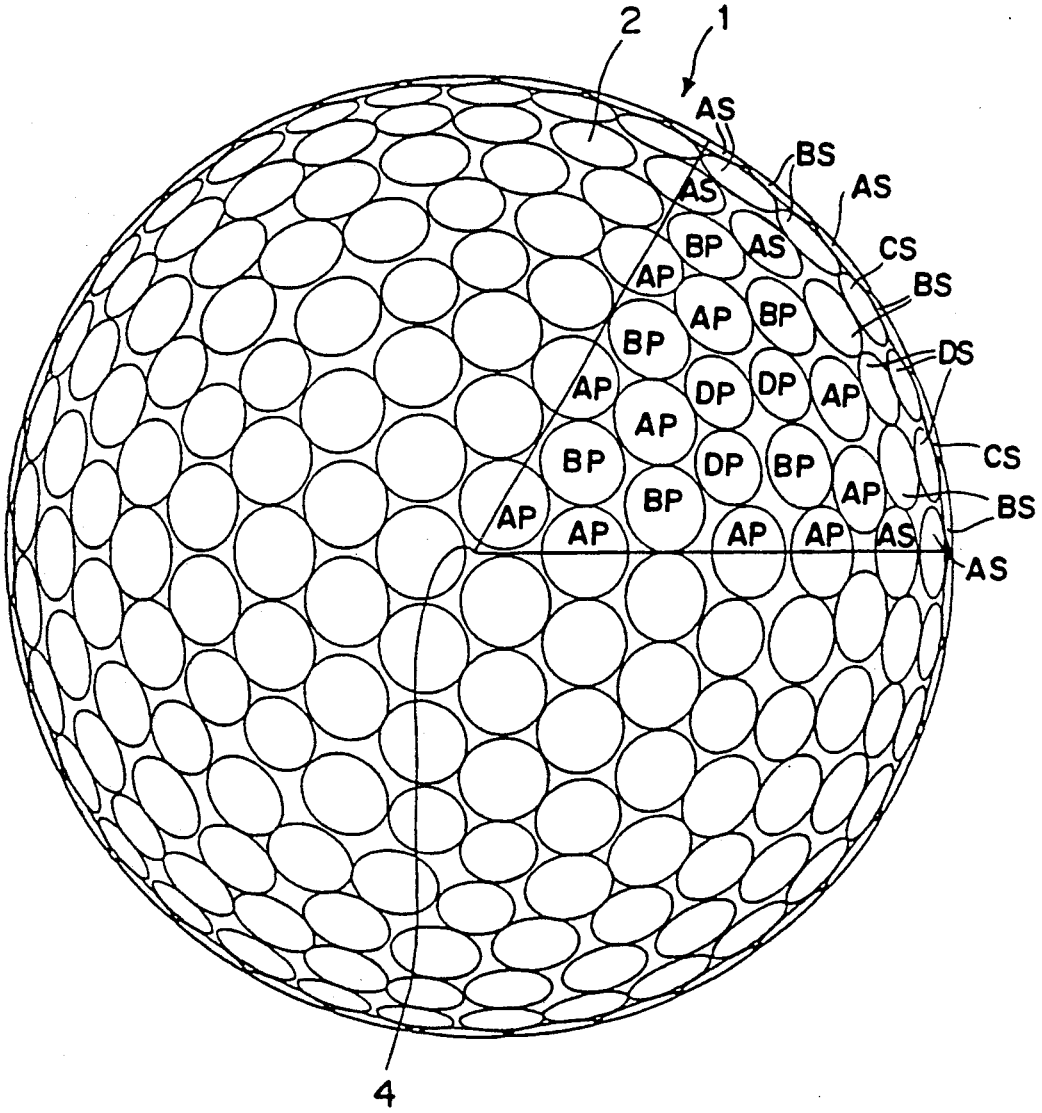
FIG. 4C is a view similar to FIG. 4A which particularly shows arrangement of dimples according to kinds thereof.
Figure 5A:
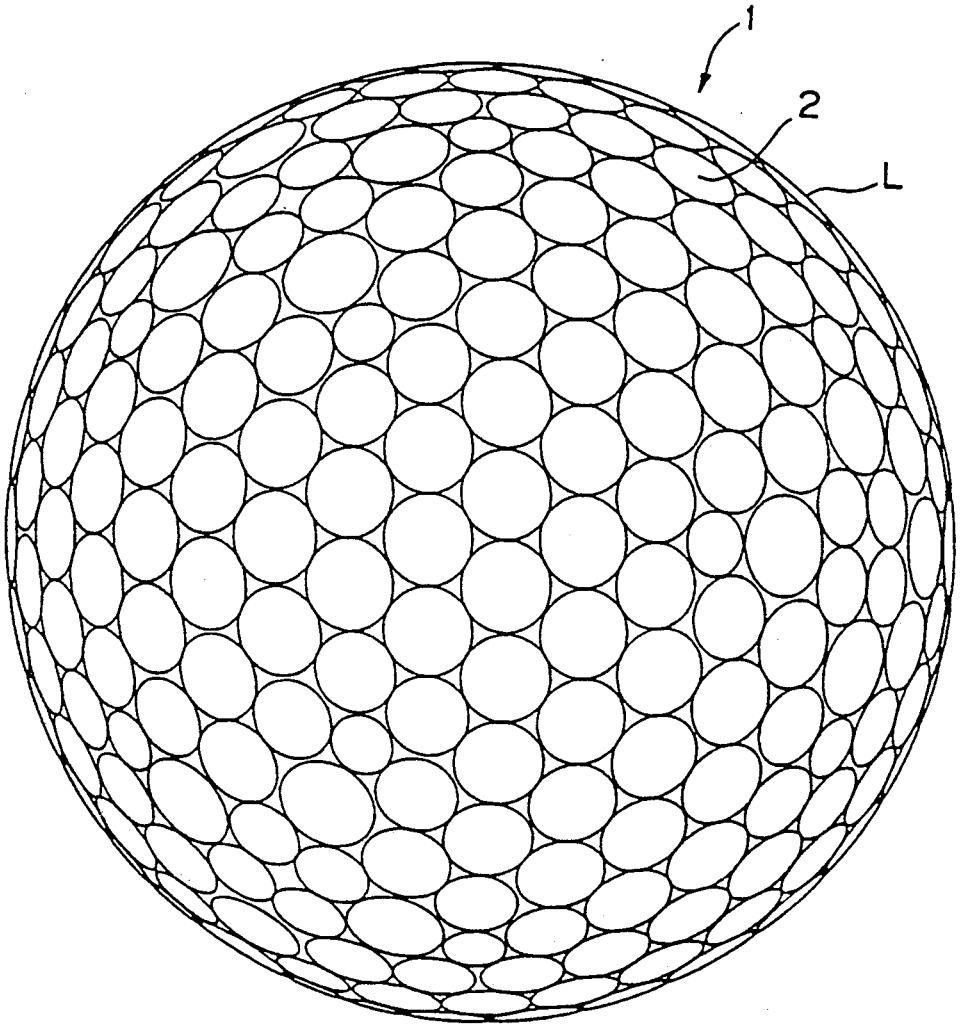
FIG. 5A is a front view showing a golf ball, according to a fourth embodiment of the present invention, viewed in a pole direction.
Figure 5B:
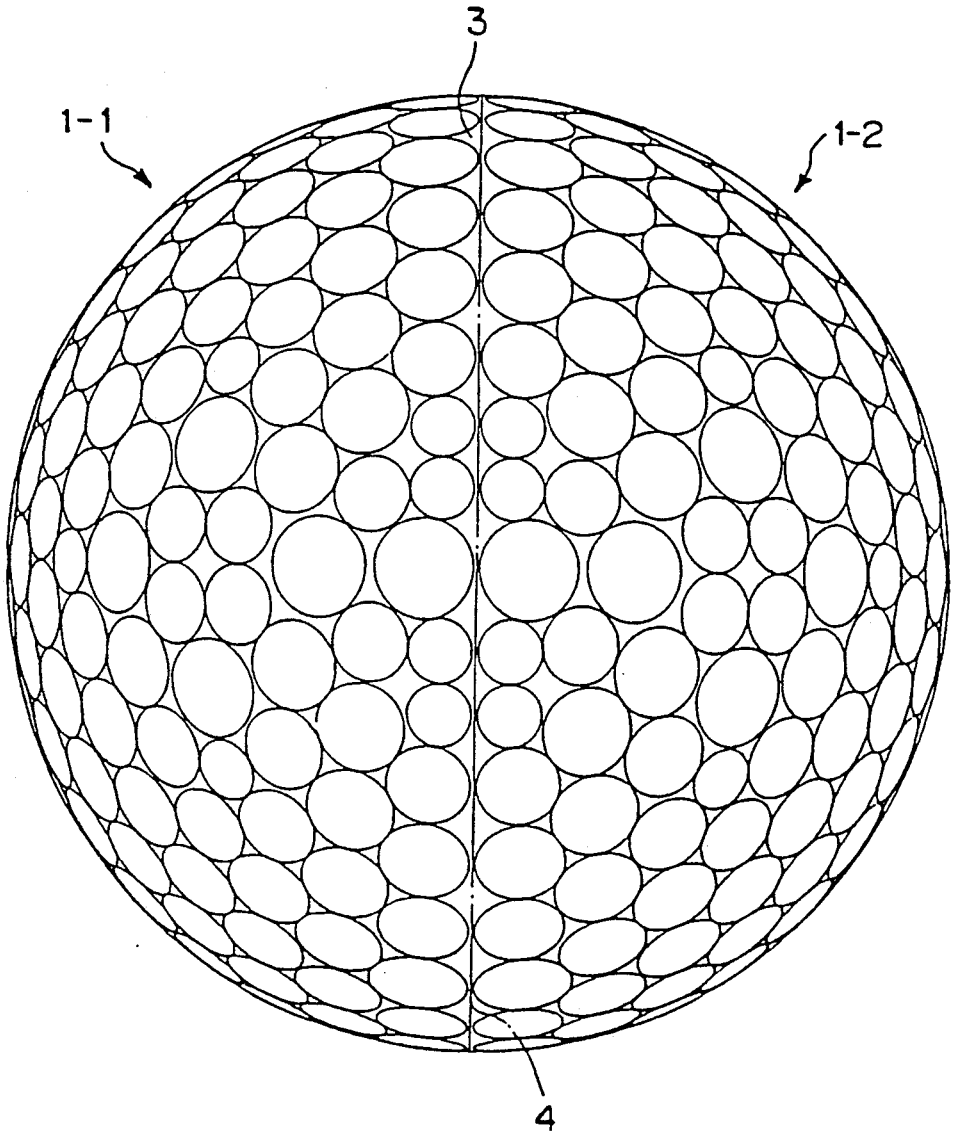
FIG. 5B is a side elevational view showing the golf ball, according to the fourth embodiment of the present invention, viewed in a parting line direction.
Figure 5C:
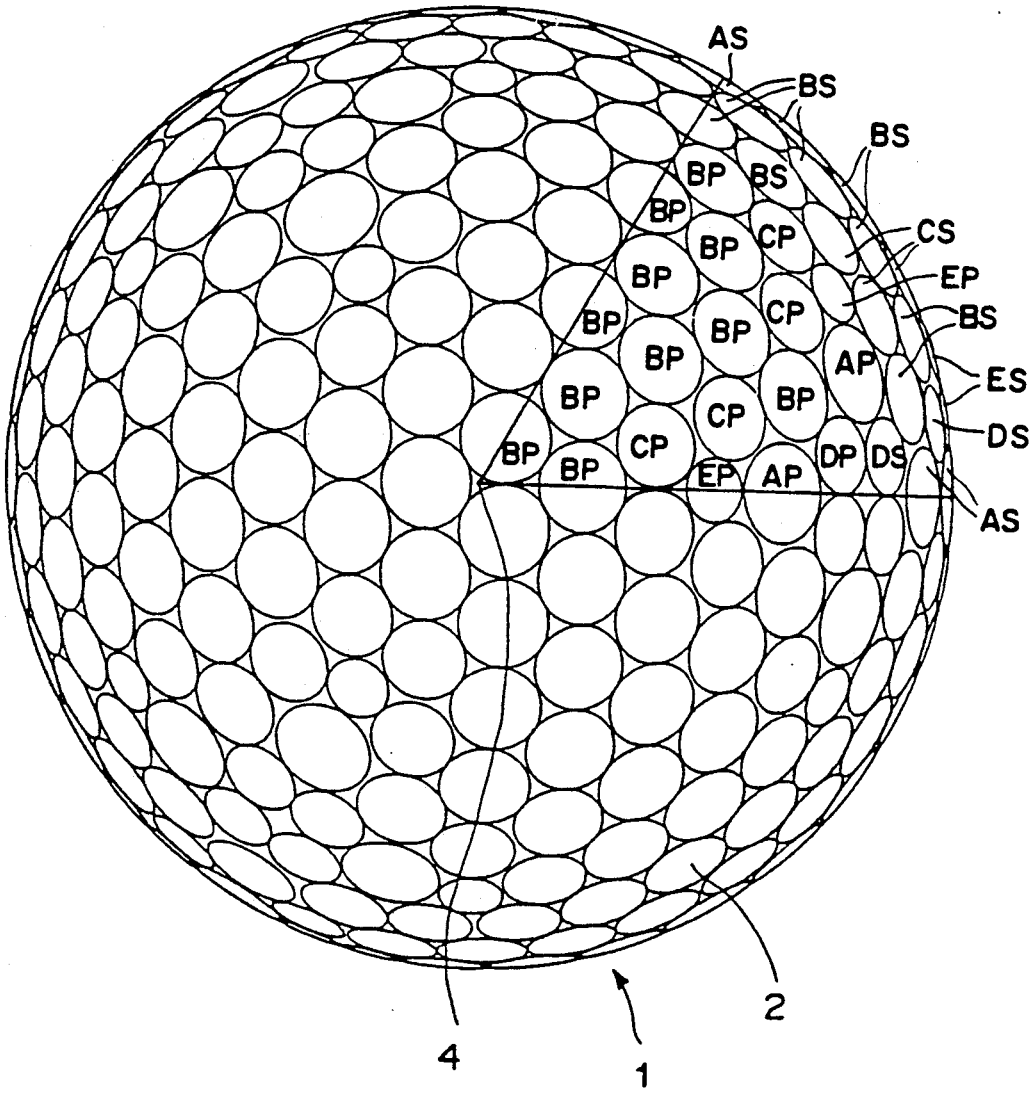
FIG. 5C is a view similar to FIG. 5A which particularly shows arrangement of dimples according to kinds thereof.
Figure 6A:
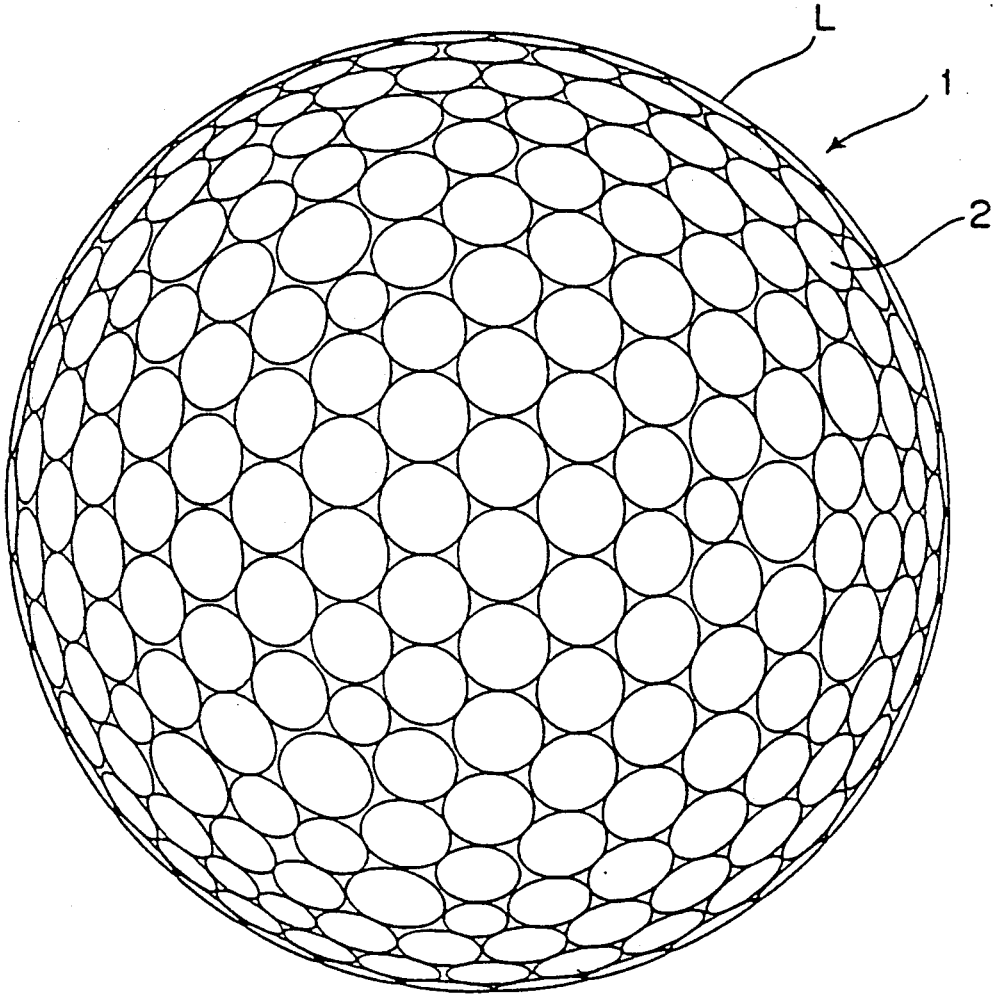
FIG. 6A is a front view showing a golf ball, according to a fifth embodiment of the present invention, viewed in a pole direction.
Figure 6B:
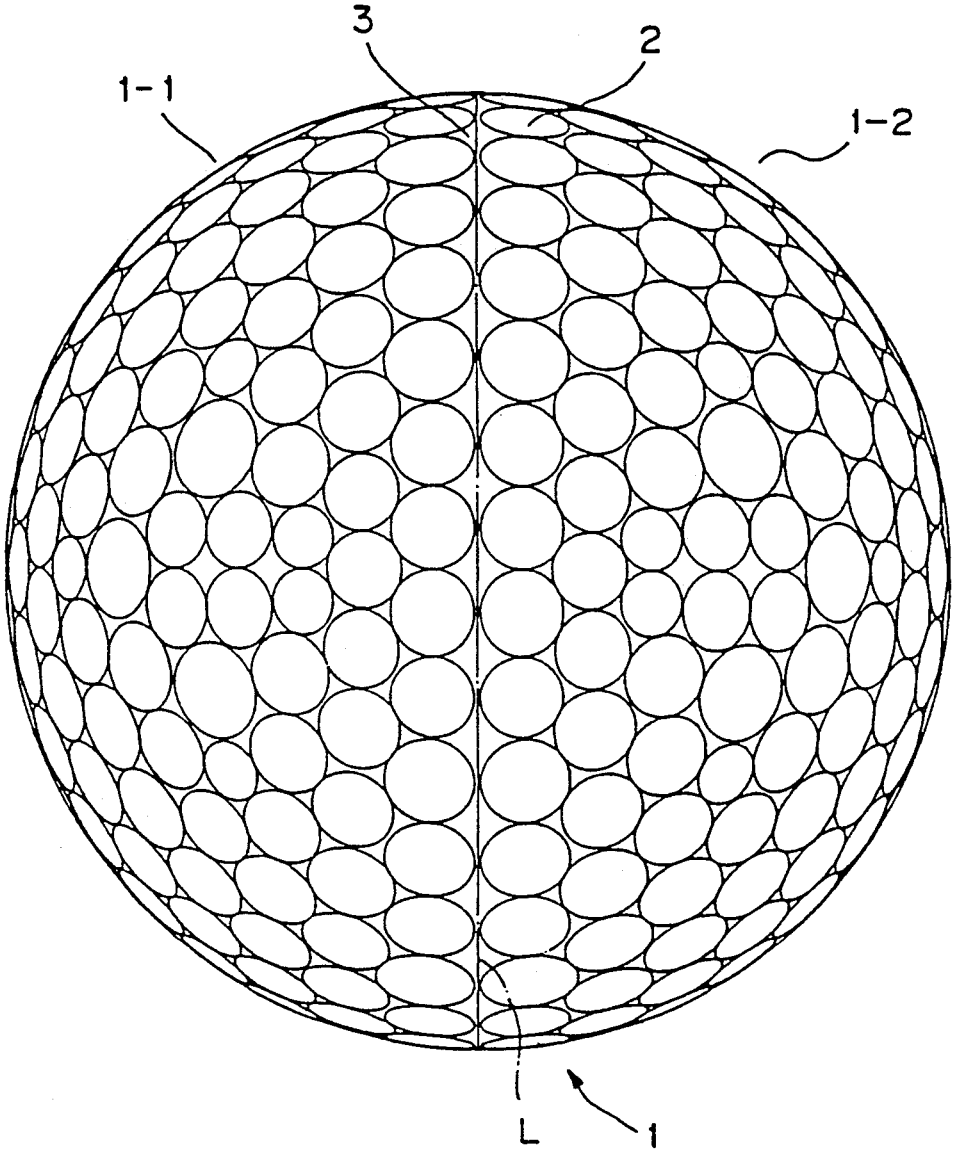
FIG. 6B is a side elevational view showing the golf ball, according to the fifth embodiment of the present invention, viewed in a parting line direction.
Figure 6C:
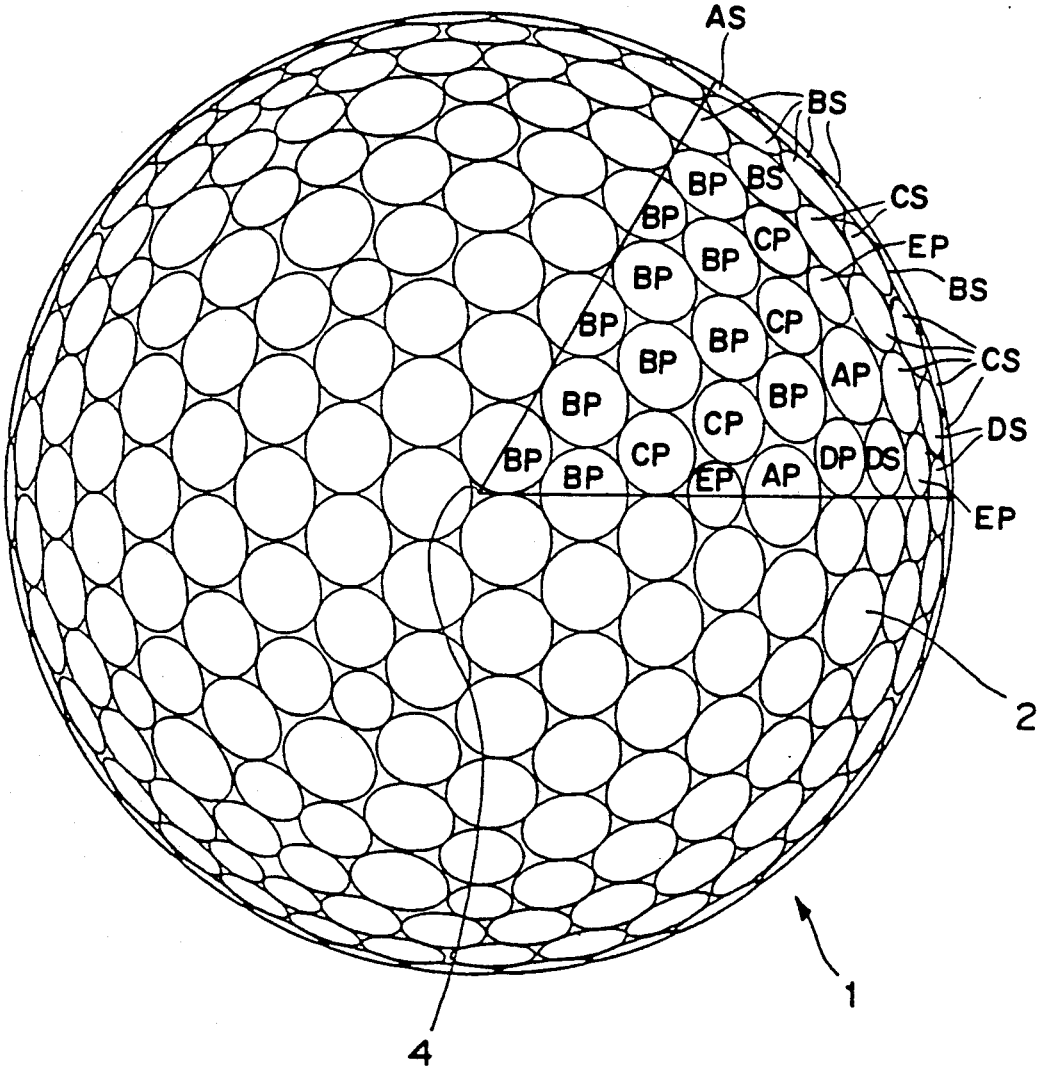
FIG. 6C is a view similar to FIG. 6A which particularly shows arrangement of dimples according to kinds thereof.
Figure 7A:
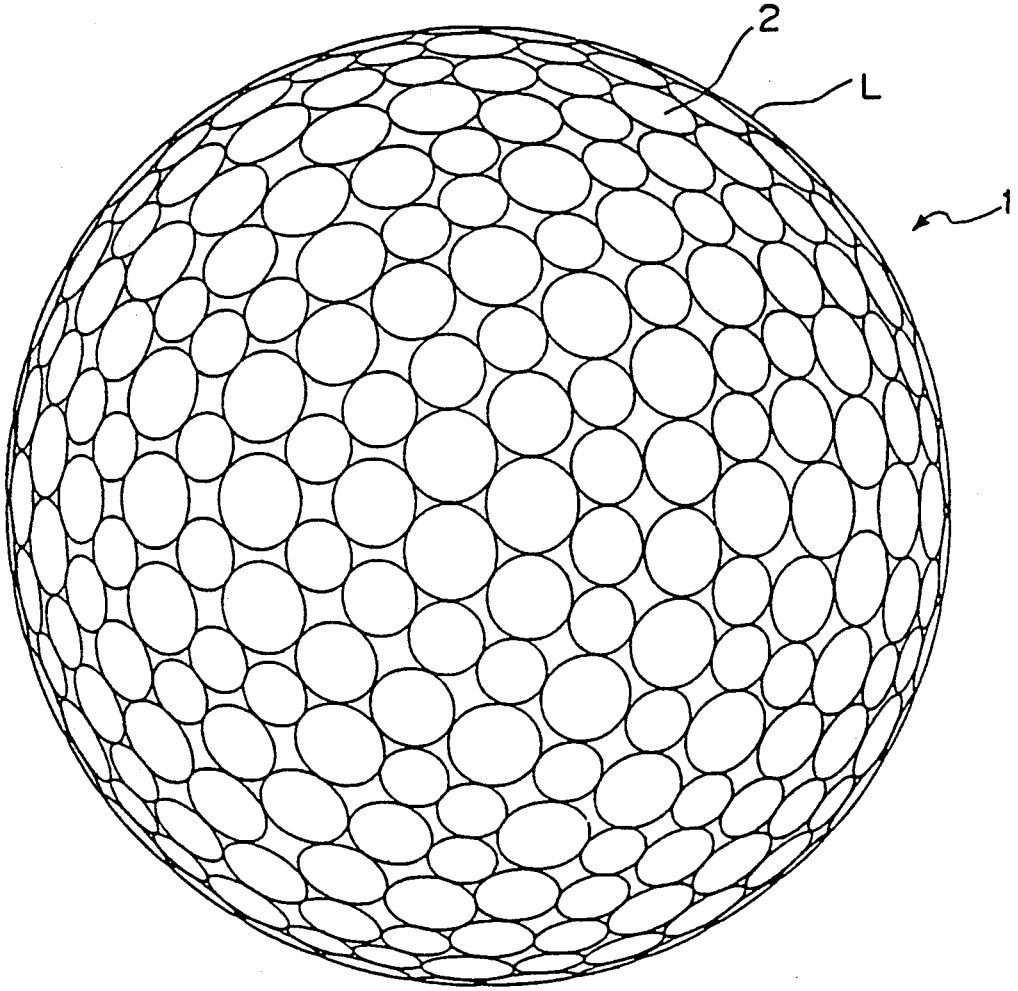
FIG. 7A is a front view showing a golf ball, according to a sixth embodiment of the present invention, viewed in a pole direction.
Figure 7B:
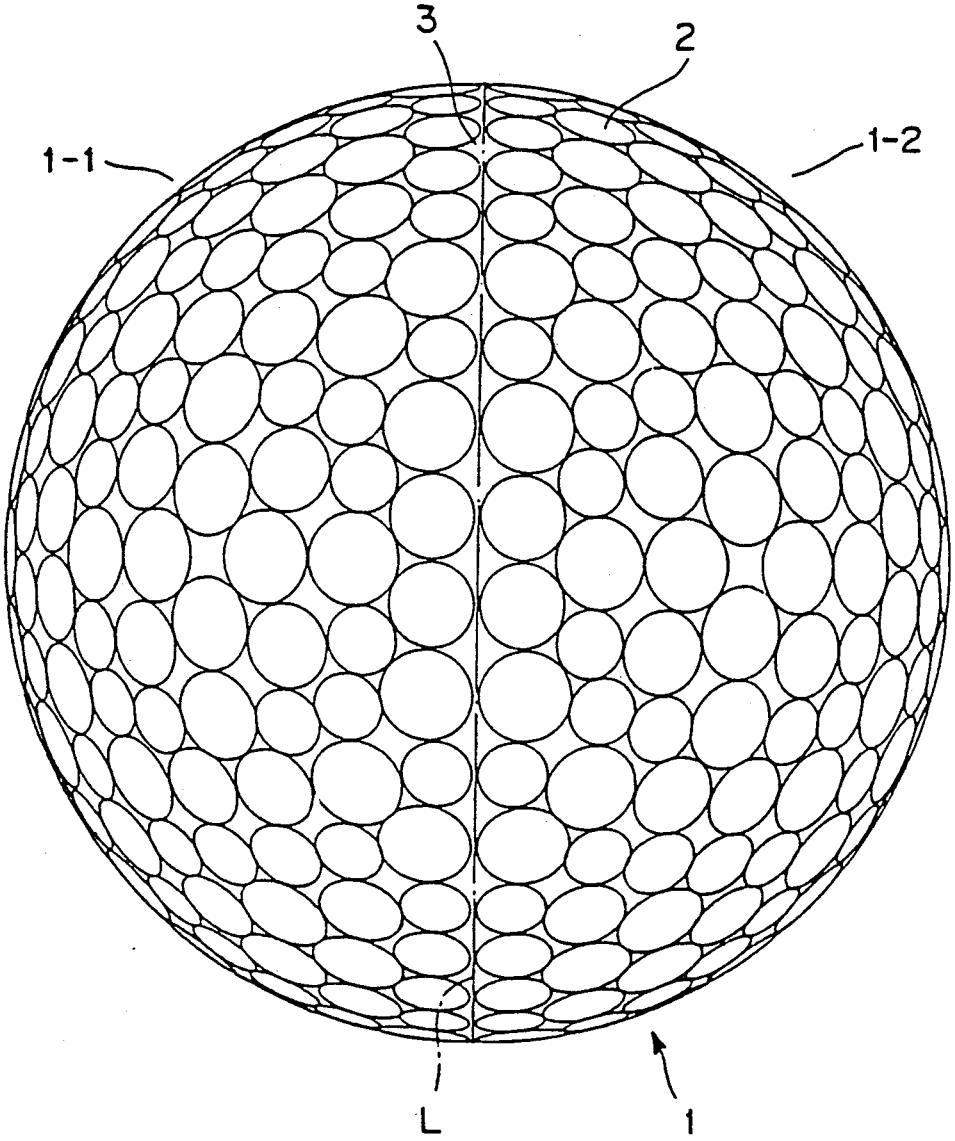
FIG. 7B is a side elevational view showing the golf ball, according to the sixth embodiment of the present invention, viewed in a parting line direction.
Figure 7C:
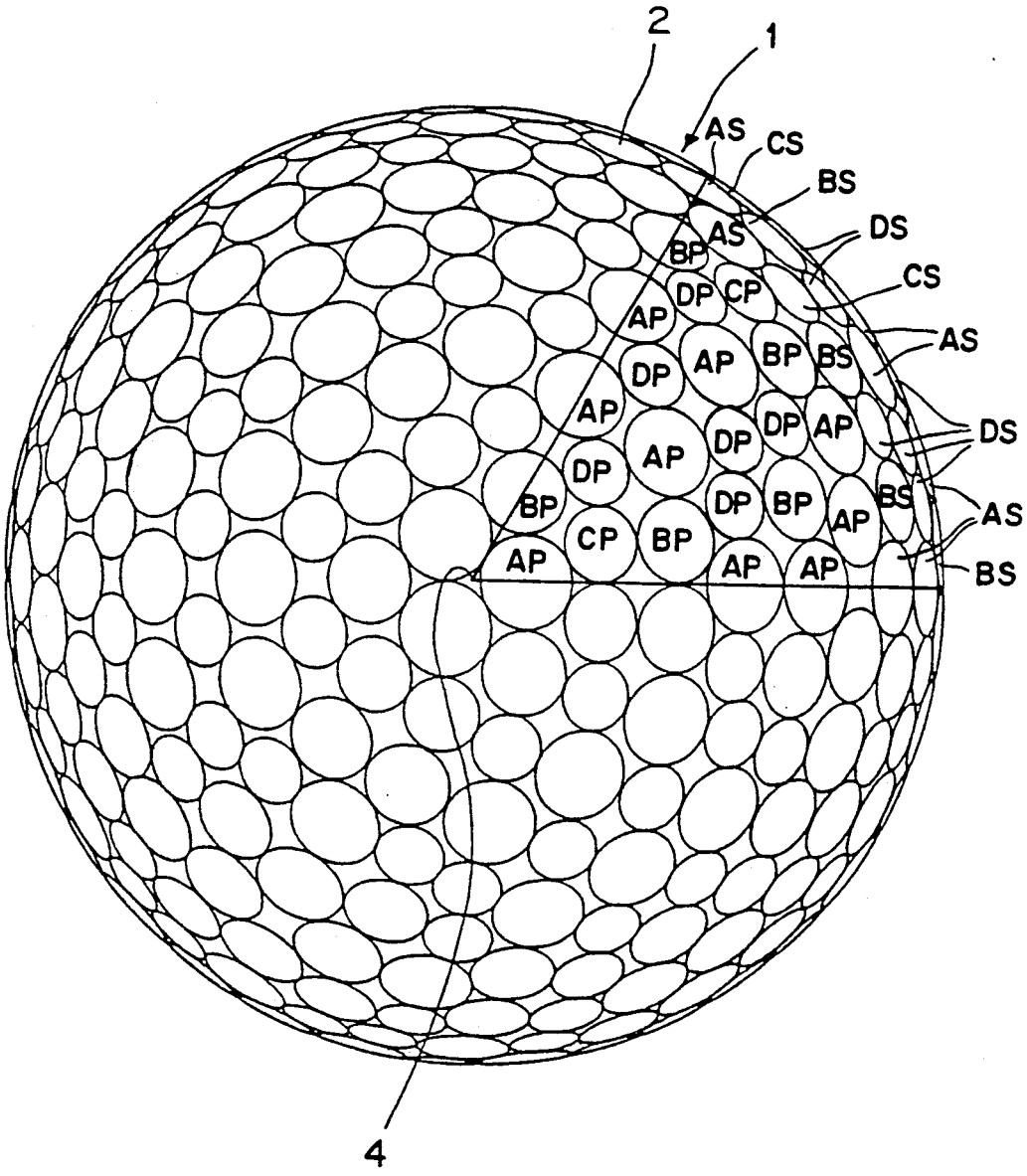
FIG. 7C is a view similar to FIG. 7A which particularly shows arrangement of dimples according to kinds thereof.
Figure 8A:
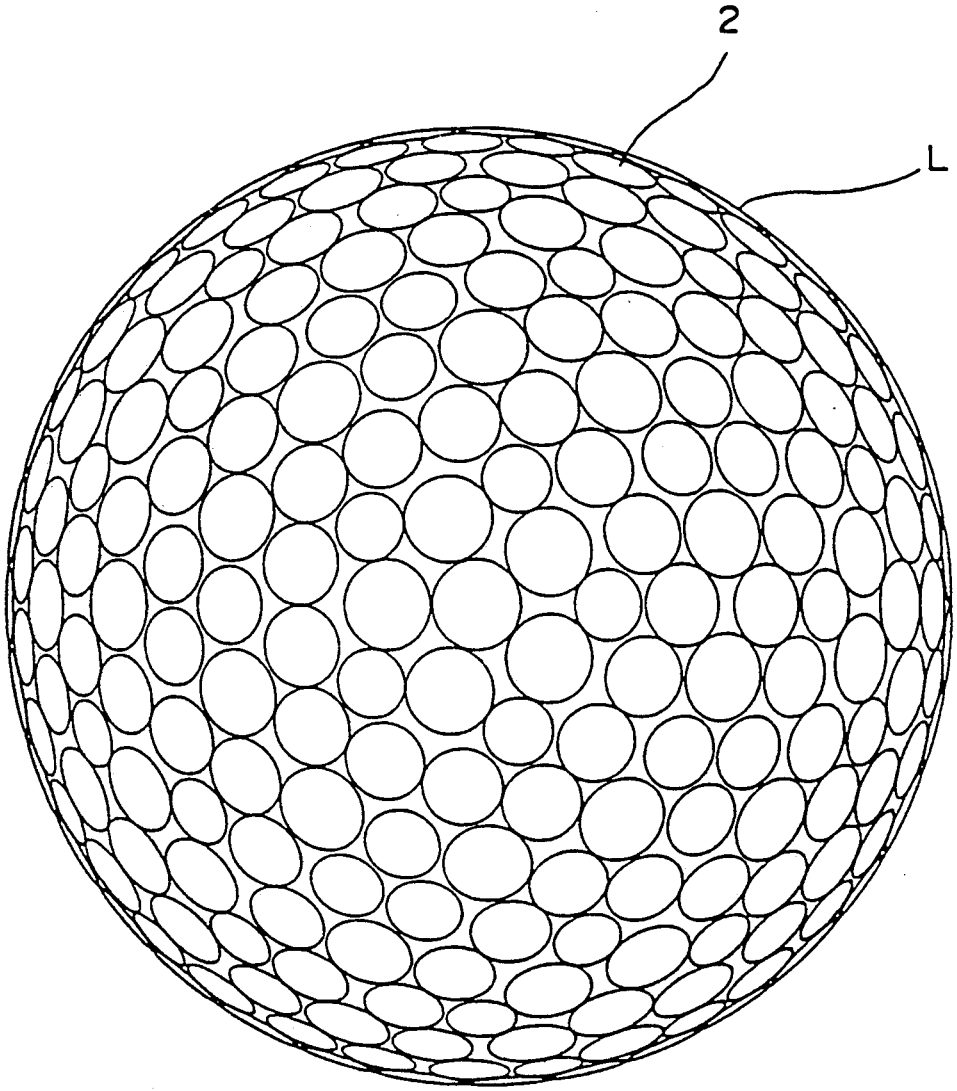
FIG. 8A is a front view showing a golf ball, according to a seventh embodiment of the present invention, viewed in a pole direction.
Figure 8B:
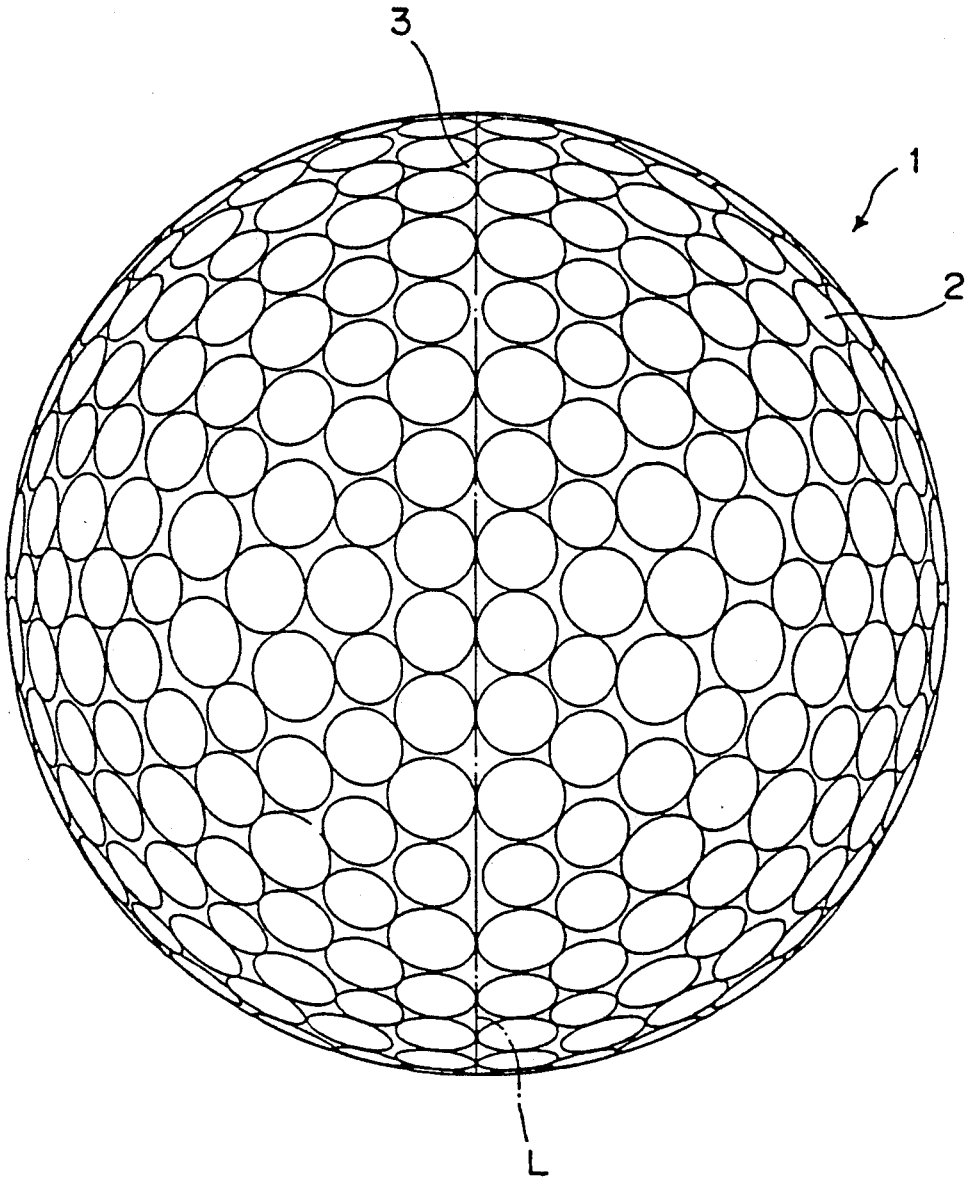
FIG. 8B is a side elevational view showing the golf ball, according to the seventh embodiment of the present invention, viewed in a parting line direction.
Figure 8C:
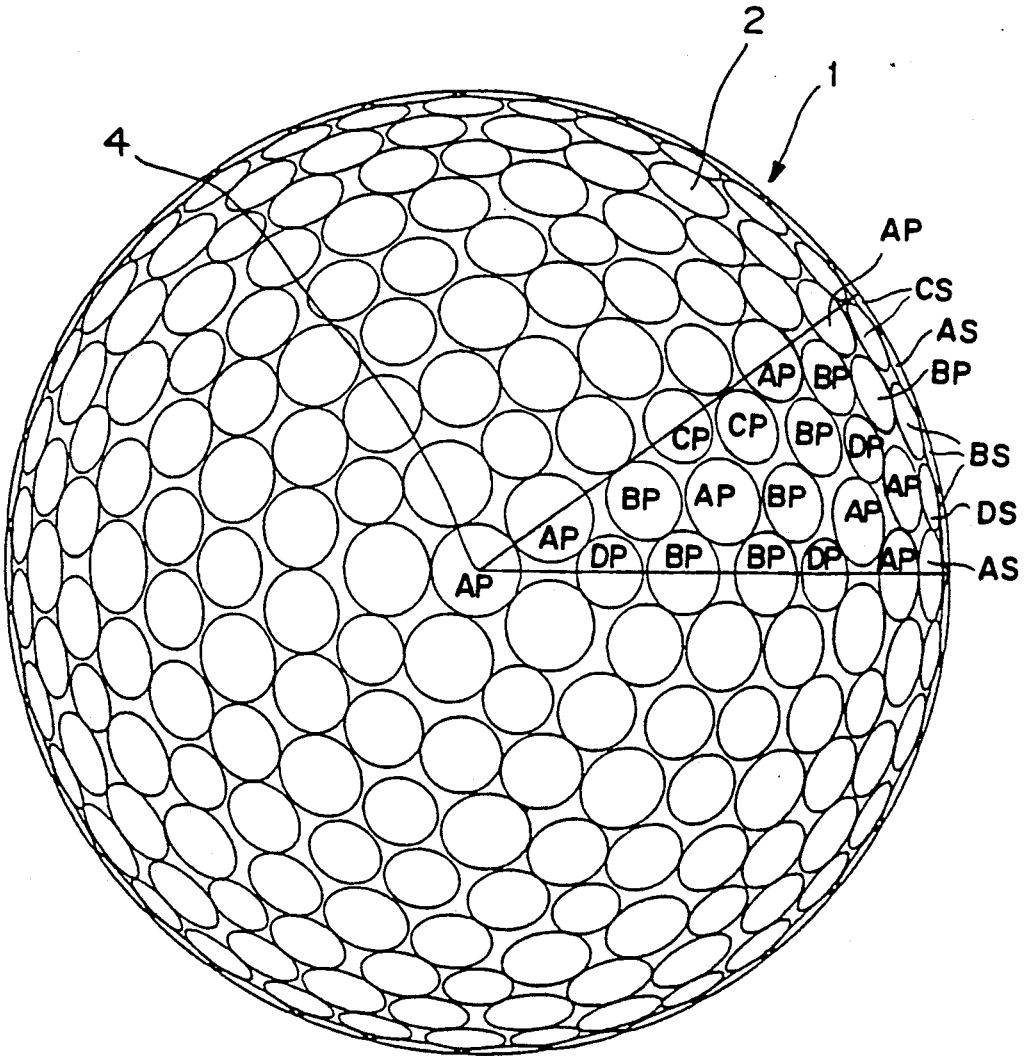
FIG. 8C is a view similar to FIG. 8A which particularly shows arrangement of dimples according to kinds thereof.

FIGS. 3A, 3B, and 3C show a second embodiment of the present invention. FIGS. 4A, 4B, and 4C show a third embodiment thereof. FIGS. 5A, 5B, and 5C show a fourth embodiment thereof. FIGS. 6A, 6B, and 6C show a fifth embodiment thereof. FIGS. 7A, 7B, and 7C show a sixth embodiment thereof. FIGS. 8A, 8B, and 8C show a seventh embodiment thereof. Similarly to the first embodiment, A, B, and C of these figures show a front view in which the golf ball is viewed in a pole direction, a right side elevational view in which the golf ball is viewed in the parting line direction, a layout view of dimples(i.e. arrangement of dimples according to kinds thereof), respectively.

The dimple specifications of the first through seventh embodiment are as shown in Table 1 below. The central angle $\theta$ for dividing the spherical surface of the golf ball is 30° each in the second through sixth embodiment and 20° in the seventh embodiment. Similarly to the first embodiment, dimples are arranged symmetrically with respect to the face including the parting line L in the second through seventh embodiment.

TABLE 1

(dimple specification)

| | total number of dimples | name of dimple | curvature (mm) | zone | number of dimples | diameter (mm) | depth (mm) | volume ($mm^3$) | total volume dimples ($mm^3$) | VS/VP |
|---|---|---|---|---|---|---|---|---|---|---|
| first embodiment | 360 | A | 13.3 | S | 126 | 4.24 | 0.170 | 1.203 | 385 | 1.08 |
| | | | | P | 126 | 4.16 | 0.164 | 1.113 | | |
| | | B | 11.5 | S | 36 | 3.93 | 0.169 | 1.027 | | |
| | | | | P | 24 | 3.86 | 0.163 | 0.951 | | |
| | | C | 9.3 | P | 12 | 3.50 | 0.166 | 0.802 | | |
| | | D | 7.8 | S | 24 | 3.22 | 0.168 | 0.686 | | |
| | | | | P | 12 | 3.16 | 0.162 | 0.635 | | |
| second embodiment | 368 | A | 12.7 | S | 84 | 4.25 | 0.188 | 1.336 | 386 | 1.10 |
| | | | | P | 84 | 4.15 | 0.179 | 1.214 | | |
| | | B | 10.4 | S | 30 | 3.84 | 0.188 | 1.097 | | |
| | | | | P | 30 | 3.75 | 0.180 | 0.997 | | |
| | | C | 8.4 | S | 48 | 3.43 | 0.187 | 0.867 | | |
| | | | | P | 36 | 3.35 | 0.178 | 0.788 | | |
| | | D | 7.0 | S | 30 | 3.13 | 0.186 | 0.719 | | |
| | | | | P | 26 | 3.06 | 0.177 | 0.654 | | |
| third embodiment | 384 | A | 12.4 | S | 60 | 4.11 | 0.171 | 1.135 | 383 | 1.10 |
| | | | | P | 84 | 4.01 | 0.163 | 1.032 | | |
| | | B | 11.8 | S | 72 | 4.00 | 0.170 | 1.071 | | |
| | | | | P | 72 | 3.90 | 0.162 | 0.973 | | |
| | | C | 10.9 | S | 24 | 3.80 | 0.167 | 0.949 | | |
| | | D | 9.3 | S | 36 | 3.54 | 0.170 | 0.840 | | |
| | | | | P | 36 | 3.46 | 0.162 | 0.764 | | |
| fourth embodiment | 408 | A | 16.4 | S | 18 | 4.55 | 0.159 | 1.294 | 383 | 1.10 |
| | | | | P | 18 | 4.45 | 0.151 | 1.176 | | |
| | | B | 13.6 | S | 102 | 4.15 | 0.159 | 1.078 | | |
| | | | | P | 108 | 4.05 | 0.152 | 0.980 | | |
| | | C | 11.7 | S | 36 | 3.85 | 0.160 | 0.931 | | |
| | | | | P | 48 | 3.76 | 0.152 | 0.847 | | |
| | | D | 10.0 | S | 12 | 3.56 | 0.159 | 0.792 | | |
| | | | | P | 24 | 3.47 | 0.152 | 0.720 | | |
| | | E | 6.9 | S | 24 | 2.93 | 0.157 | 0.532 | | |
| | | | | P | 18 | 2.86 | 0.150 | 0.483 | | |
| fifth embodiment | 414 | A | 16.4 | S | 6 | 4.58 | 0.161 | 1.325 | 384 | 1.10 |
| | | | | P | 18 | 4.48 | 0.153 | 1.205 | | |
| | | B | 13.6 | S | 78 | 4.12 | 0.160 | 1.085 | | |
| | | | | P | 108 | 4.06 | 0.152 | 0.987 | | |
| | | C | 11.7 | S | 84 | 3.83 | 0.158 | 0.913 | | |
| | | | | P | 48 | 3.74 | 0.151 | 0.830 | | |
| | | D | 10.0 | S | 18 | 3.55 | 0.159 | 0.785 | | |
| | | | | P | 24 | 3.46 | 0.151 | 0.713 | | |
| | | E | 6.9 | S | 12 | 2.94 | 0.158 | 0.540 | | |
| | | | | P | 18 | 2.87 | 0.151 | 0.491 | | |
| sixth embodiment | 432 | A | 13.7 | S | 66 | 4.25 | 0.166 | 1.182 | 380 | 1.10 |
| | | | | P | 78 | 4.15 | 0.158 | 1.075 | | |
| | | B | 11.5 | S | 48 | 3.90 | 0.166 | 0.992 | | |
| | | | | P | 48 | 3.80 | 0.158 | 0.902 | | |
| | | C | 9.3 | S | 24 | 3.49 | 0.165 | 0.793 | | |
| | | | | P | 24 | 3.41 | 0.158 | 0.721 | | |
| | | D | 7.8 | S | 72 | 3.19 | 0.164 | 0.658 | | |
| | | | | P | 72 | 3.11 | 0.157 | 0.598 | | |
| seventh embodiment | 432 | A | 12.0 | S | 30 | 4.04 | 0.171 | 1.097 | 385 | 1.05 |
| | | | | P | 102 | 3.99 | 0.167 | 1.045 | | |
| | | B | 10.0 | S | 60 | 3.68 | 0.171 | 0.910 | | |
| | | | | P | 120 | 3.64 | 0.167 | 0.867 | | |
| | | C | 8.9 | S | 30 | 3.47 | 0.171 | 0.810 | | |
| | | | | P | 30 | 3.43 | 0.167 | 0.772 | | |
| | | D | 7.5 | S | 20 | 3.18 | 0.170 | 0.675 | | |
| | | | | P | 40 | 3.14 | 0.166 | 0.643 | | |

Figure 9:
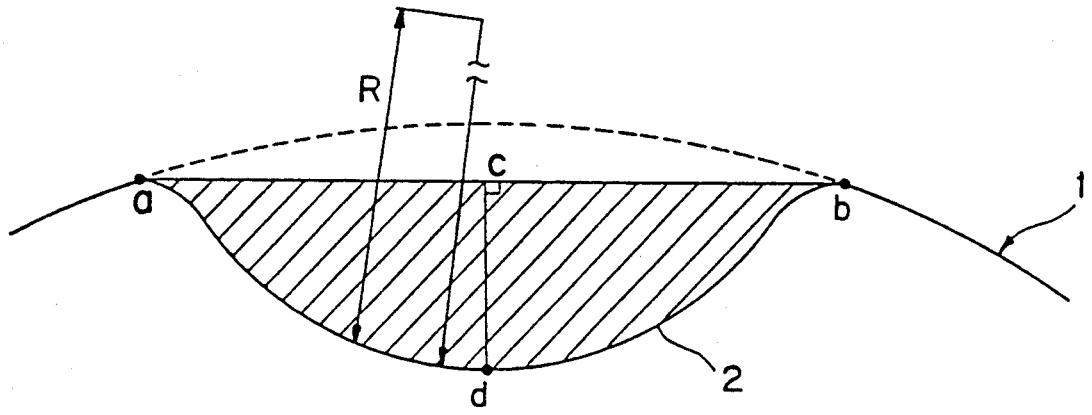
FIG. 9 is a sectional view showing a dimple according to the present invention.

Referring to FIG. 9, the dimple specifications shown in Table 1 are described below. The curvature of a dimple is shown by R of FIG. 9. The dimple diameter means a distance between connecting points when the outer peripheral edges at the left and right of the dimple are connected by a line, i.e. a distance between the points a and b in FIG. 9, and the depth of the dimple represents a length of a perpendicular from the above line onto the deepest point of the dimple, i.e. a distance c to d in FIG. 9. The dimple volume means the volume in the hatched portion in FIG. 9, and the sum total of the volumes of all dimples for one golf ball become the total volume.

In order to examine the operation and advantage of a deviation of the golf ball in putting and the symmetricalness thereof in flight according to the present invention, golf balls having the same specifications as those of the first through seventh embodiment and dimples arranged unsymmetrically with respect to the face including the parting line were prepared as comparative examples in comparisons with the golf balls of the first through seventh embodiment.

Figure 10:
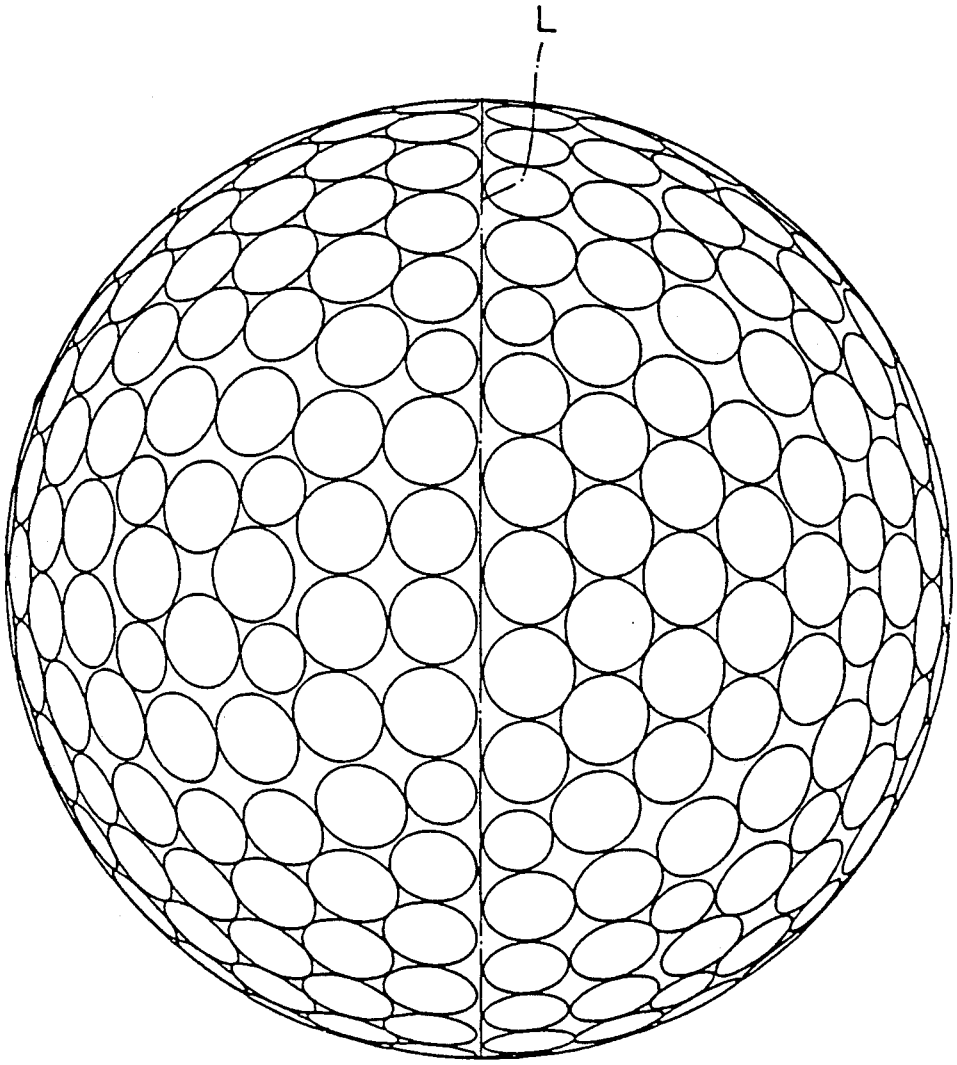
FIGS. 10 through 16 are each side elevational view showing a golf ball, of first through seventh comparative examples to be compared with the golf ball according to the present invention, viewed in a parting line direction.
Figure 11:
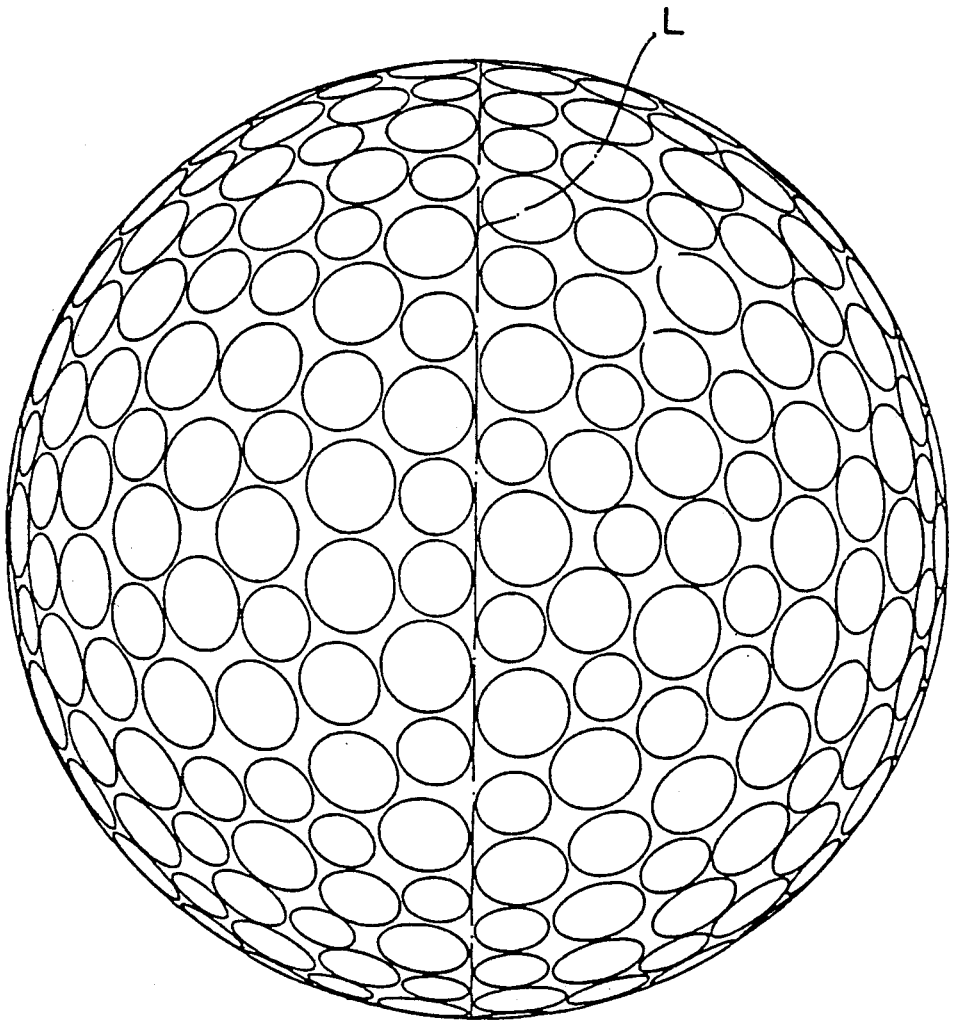
Figure 12:
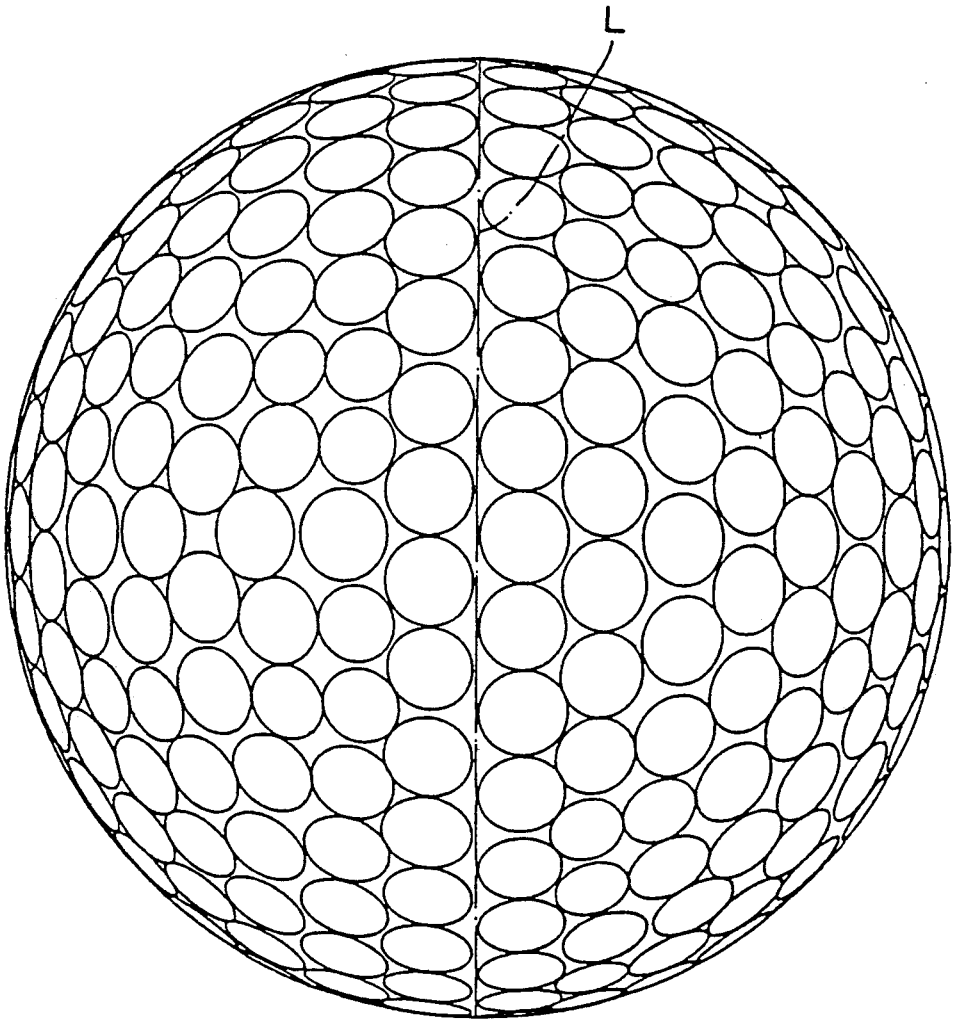
Figure 13:
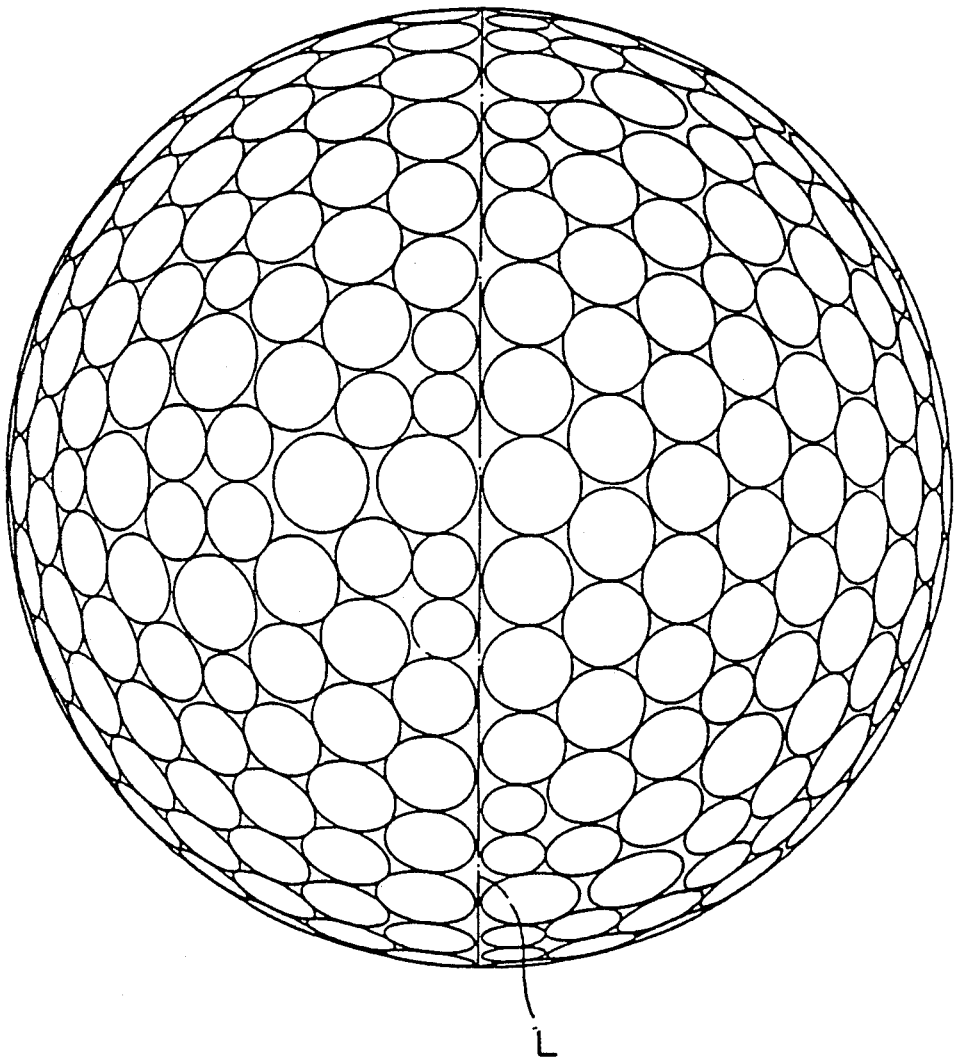
Figure 14:
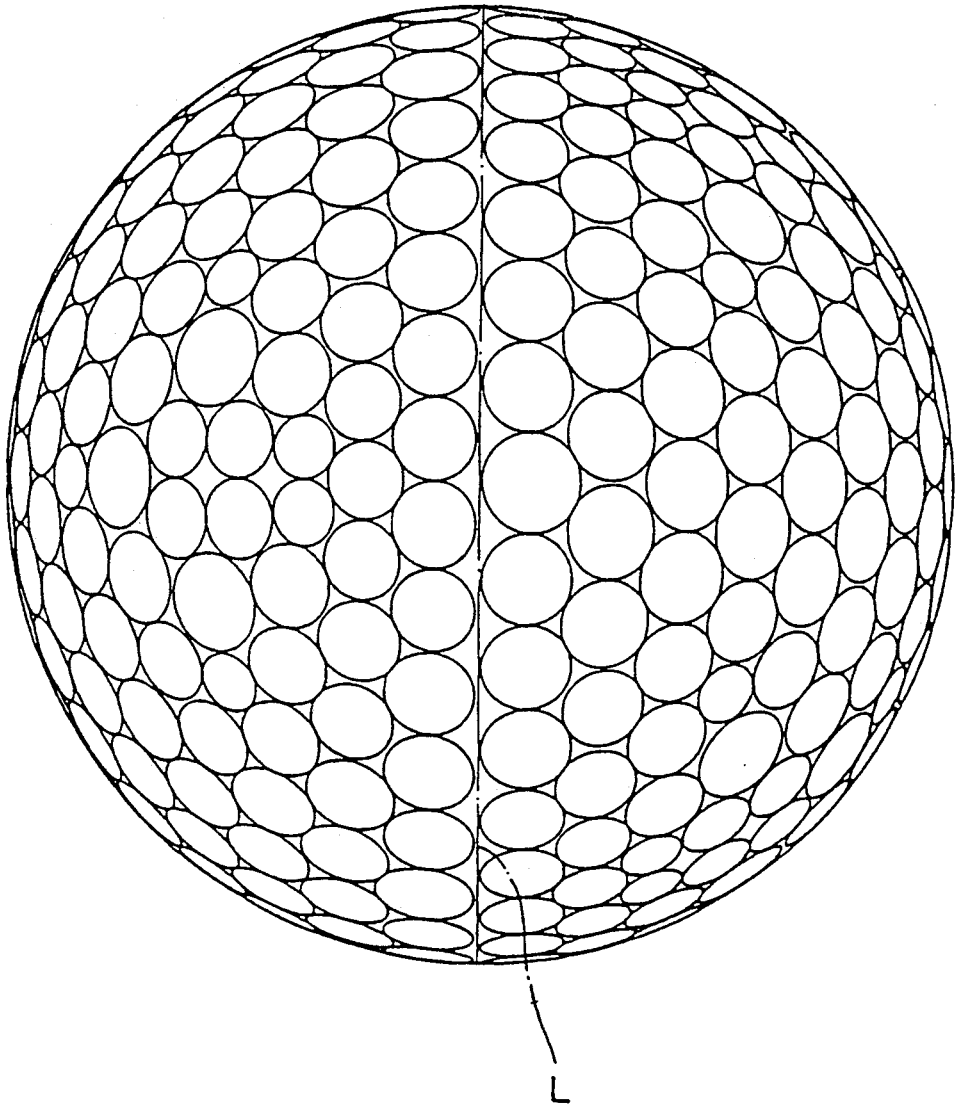
Figure 15:
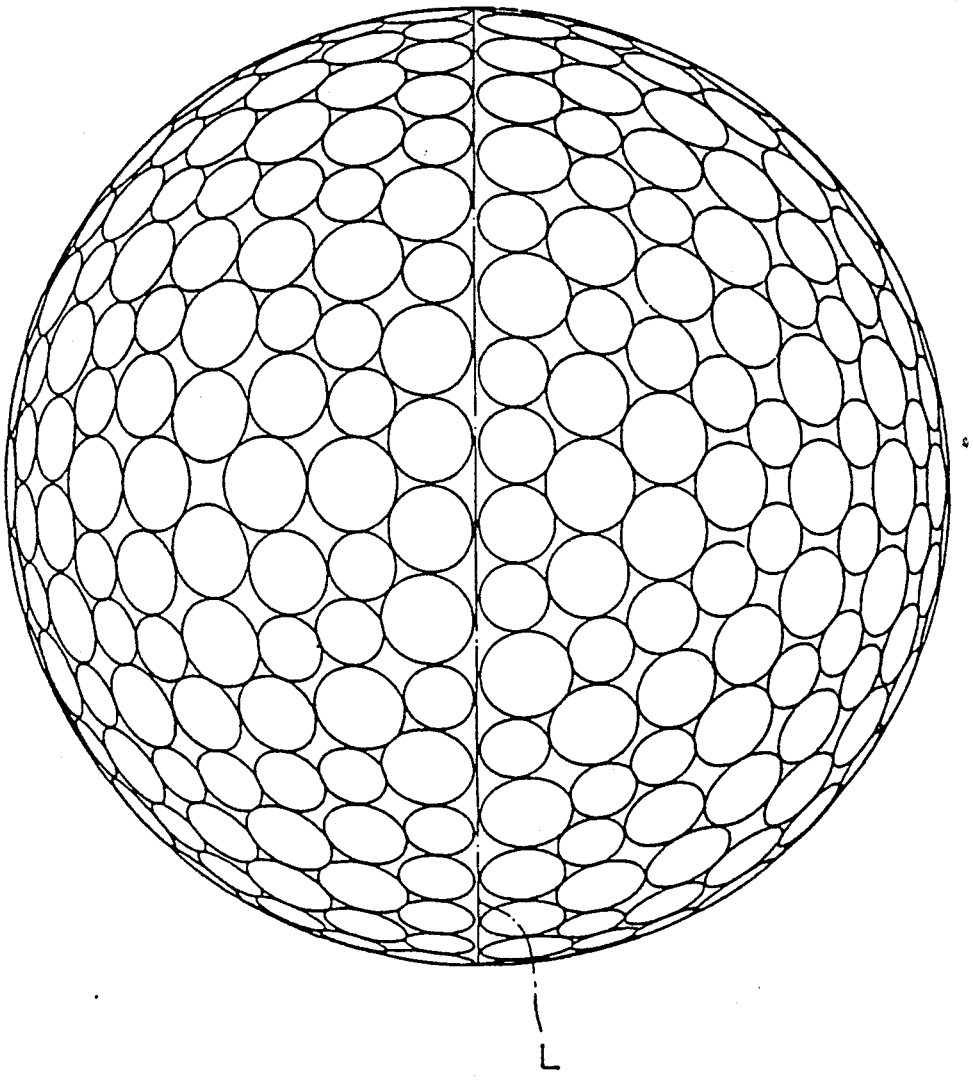
Figure 16:
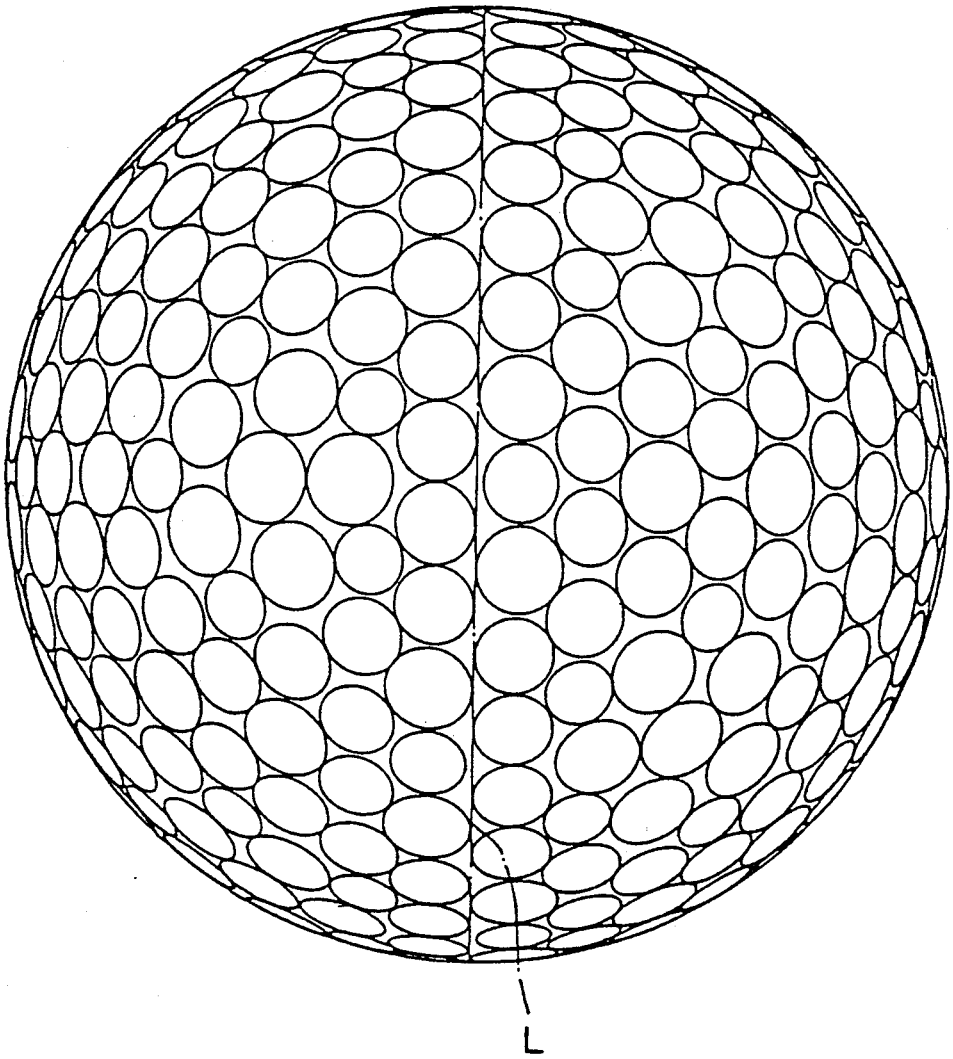

That is, a first comparative example shown in FIG. 10 corresponds to the first embodiment. A second comparative example shown in FIG. 11 corresponds to the second embodiment. A third comparative example shown in FIG. 12 corresponds to the third embodiment. A fourth comparative example shown in FIG. 13 corresponds to the fourth embodiment. A fifth comparative example shown in FIG. 14 corresponds to the fifth embodiment. A sixth comparative example shown in FIG. 15 corresponds to the sixth embodiment. A seventh comparative example shown in FIG. 16 corresponds to the seventh embodiment. The golf balls of the first through seventh comparative examples are identical to those of the golf balls of the first through seventh embodiment in the front view and the dimple layout view, respectively. But the side elevational views of FIG. 10 through 16 of the golf balls of the first through seventh comparative examples are different from those of FIG. 2C through FIG. 8C showing a golf ball viewed from the parting line direction.

As described above and shown in Table 2 below, each of the dimple specifications of the first through seventh comparative examples is the same as that of the first through seventh embodiment shown in Table 1, respectively.

Figure 17A:
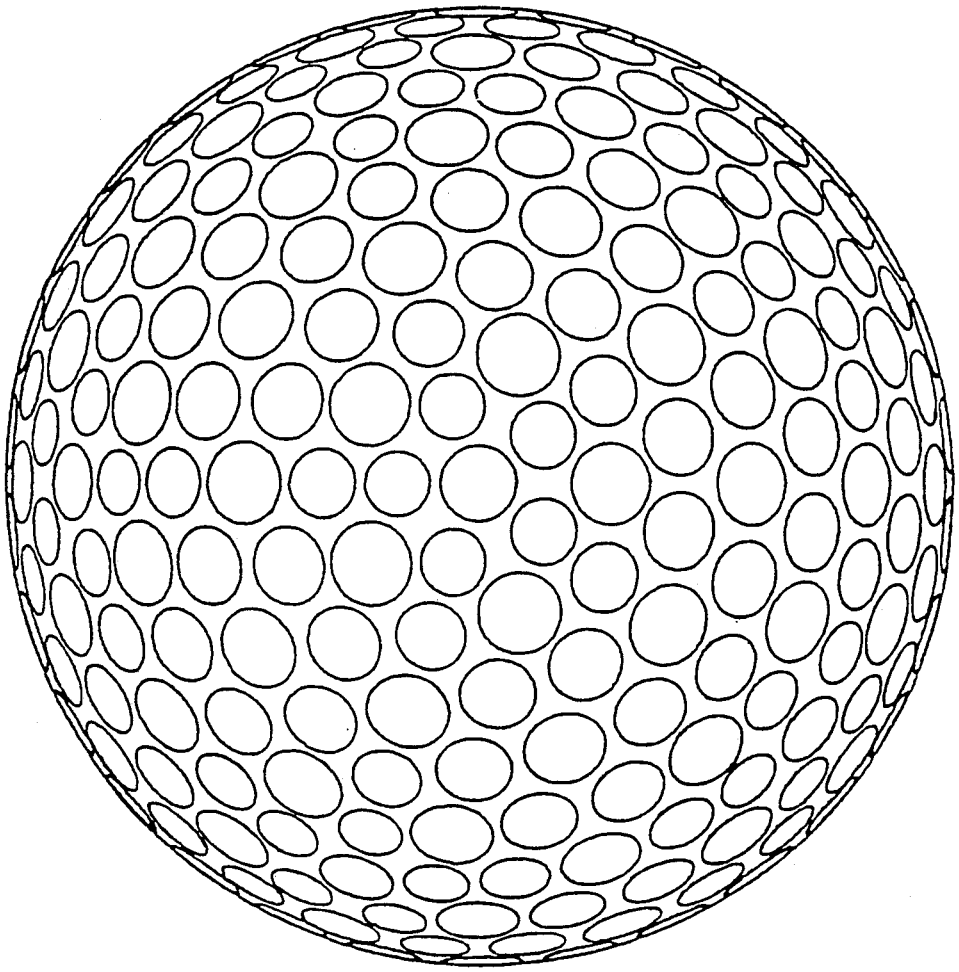
FIG. 17A is a front view showing a golf ball, according to an eighth comparative example, viewed in a pole direction.
Figure 17B:
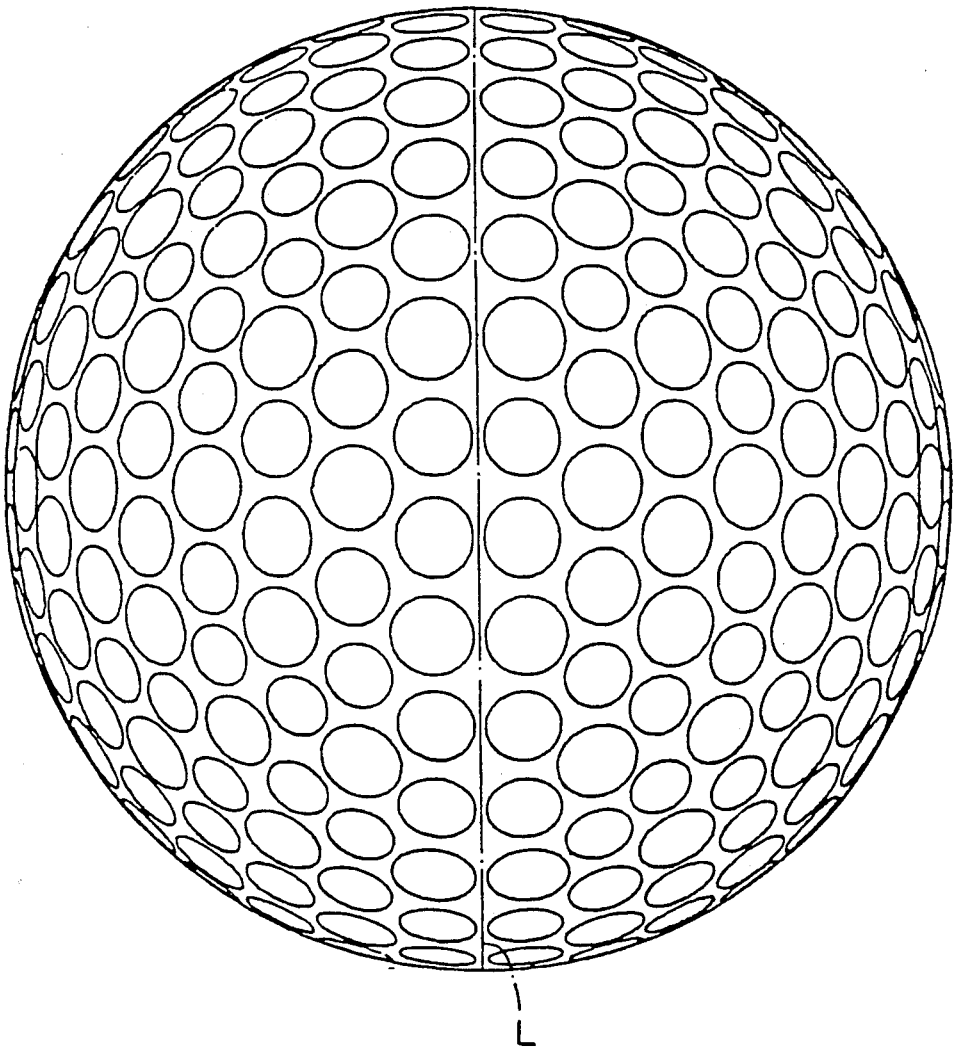
FIG. 17B is a side elevational view showing a golf ball, according to the eighth comparative example, viewed in a parting line direction.
Figure 17C:
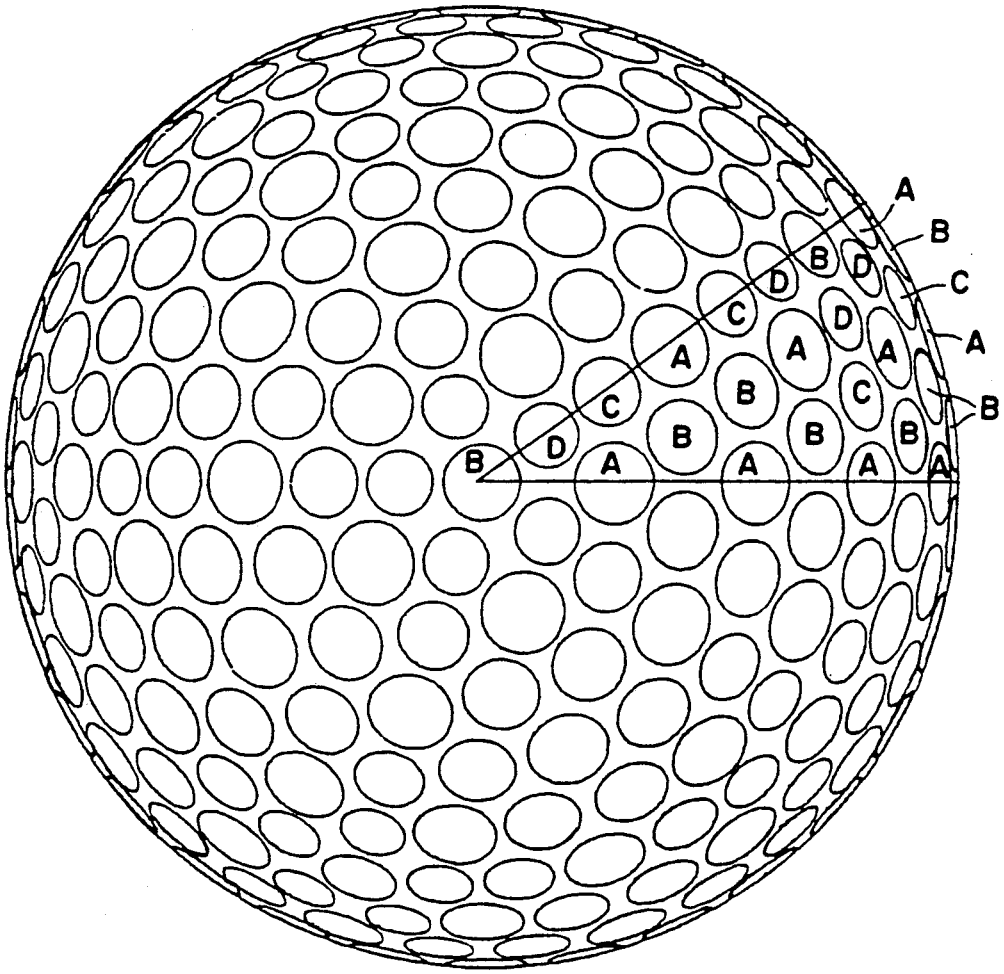
FIG. 17C is a view similar to FIG. 17A which particularly shows arrangement of dimples according to kinds thereof.
Figure 18:
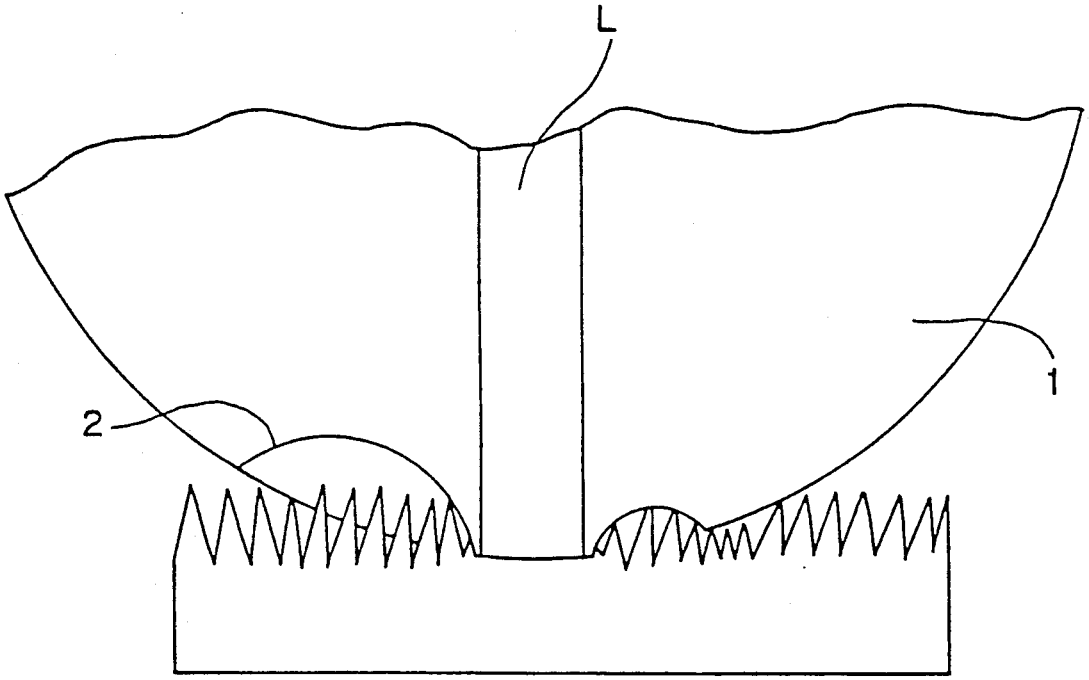
FIG. 18 is a schematic view showing the relationship between a parting line and a putting line.

Further, an eighth comparative example shown in FIGS. 17A, 17B, and 17C was prepared. Golf balls of the eighth comparative example have dimple patterns recently popular among golf players. The golf balls of the eighth comparative example has 392 dimples and as shown in FIG. 17, dimples are arranged symmetrically with respect to the face including the parting line, but the volume of a dimple arranged in the S region was not differentiated from that of a dimple arranged in the P region.

The dimple specifications of the eighth comparative example are as shown in Table 2 below.

In the first through seventh embodiment and the first through eighth comparative example, golf balls are each large-sized and threaded-wound balls having liquid centers and balata covers. The composition and construction thereof are identical to each other. The compressions are also same, namely, 95 ±2.

TABLE 2

(dimple specification)

| | total number of dimples | name of dimple | curvature (mm) | zone | number of dimples | diameter (mm) | depth (mm) | volume ($mm^3$) | total volume ($mm^3$) | VS/VP |
|---|---|---|---|---|---|---|---|---|---|---|
| eighth comparative example | 392 | A | 10.5 | — | 120 | 3.95 | 0.187 | 1.152 | 384 | — |
| | | B | 8.9 | — | 152 | 3.65 | 0.189 | 0.993 | | |
| | | C | 7.5 | — | 60 | 3.35 | 0.189 | 0.838 | | |
| | | D | 6.7 | — | 60 | 3.15 | 0.188 | 0.735 | | |
| first comparative example | dimple specification is the same as that of first embodiment | | | | | | | | | |
| second comparative example | dimple specification is the same as that of second embodiment | | | | | | | | | |
| third comparative example | dimple specification is the same as that of third embodiment | | | | | | | | | |
| fourth comparative example | dimple specification is the same as that of fourth embodiment | | | | | | | | | |
| fifth comparative example | dimple specification is the same as that of fifth embodiment | | | | | | | | | |
| sixth comparative example | dimple specification is the same as that of sixth embodiment | | | | | | | | | |
| seventh comparative example | dimple specification is the same as that of seventh embodiment | | | | | | | | | |

EXPERIMENT 1

Using a putting machine, a test was conducted to examine deviations of putted golf balls of the first through seventh embodiment and the first through seventh comparative example. The putting machine comprises a tripod and a putter hung therefrom so that the putter can swing. The head speed of the putter can be adjusted by varying the stroke of the putter when a golf ball is impacted. The stroke was adjusted to roll golf balls, on a straight line of bent lawn, approximately 7m. Distances of golf balls which have deviated from the straight line were measured.

The golf balls were placed on the straight line so that the parting lines (seam) were aligned with the putting line and were struck with a line connecting both poles serving as the rotational axis thereof of over-spin.

The absolute values of the deviation of each golf ball was (x) and 20 golf balls were repeatedly tested in each embodiment and comparative example.

The average of the result and standard deviations are shown in Table 3 below.

TABLE 3

| | Putting test X | |
|---|---|---|
| | average (cm) | standard deviation |
| first embodiment | 18.4 | 12.74 |
| second embodiment | 18.2 | 12.51 |
| third embodiment | 17.7 | 14.06 |
| fourth embodiment | 16.3 | 13.20 |
| fifth embodiment | 19.0 | 12.80 |
| sixth embodiment | 15.1 | 13.50 |
| seventh embodiment | 20.4 | 14.01 |
| first comparative example | 26.6 | 16.91 |
| second comparative example | 24.7 | 17.82 |
| third comparative example | 27.9 | 17.03 |
| fourth comparative example | 24.2 | 18.36 |
| fifth comparative example | 29.2 | 18.97 |
| sixth comparative example | 24.5 | 15.73 |
| seventh comparative example | 28.8 | 16.33 |

As shown in Table 3, the test proved that the deviations of the golf balls of the first through seventh embodiment were smaller than those of the first through seventh comparative example. The reason is that, as described previously, the golf balls of the former have dimples arranged symmetrically with respect to the face including the parting line thereof and the latter have dimples arrange unsymmetrically with respect to the face including the parting line thereof.

EXPERIMENT 2

Using a swing robot manufactured by True Temper Co., Ltd. a symmetrical characteristic test was conducted on the golf balls of the first through seventh embodiment and the eighth comparative example. The test conditions were as follows:

Club used: No. 1 driver
Head speed: 48.8 m/sec
Spin: 3500 ±300 rpm
Angle of elevation: 9° ±0.5°
Wind: against; 0.2 ~1.7m/s
Temperature of golf balls: 23° ±1° C.

The number of golf balls prepared for each embodiment and comparative example was 40. Seam hittings and pole hittings alternated with each other by using 20 golf balls each for the seam hitting and the pole hitting.

The averages of carries and trajectory heights are shown in Table 4 below.

TABLE 4

| | symmetrical character test | | |
|---|---|---|---|
| | seam hitting or pole hitting | carry (m) | trajectory height |
| first | pole hitting | 227.4 | 14.47 |
| embodiment | seam hitting | 228.0 | 14.36 |
| second | pole hitting | 231.3 | 14.25 |
| embodiment | seam hitting | 230.6 | 14.30 |
| third | pole hitting | 232.1 | 13.79 |
| embodiment | seam hitting | 231.2 | 13.92 |
| fourth | pole hitting | 234.5 | 13.80 |
| embodiment | seam hitting | 233.3 | 13.77 |
| fifth | pole hitting | 231.7 | 13.49 |
| embodiment | seam hitting | 230.7 | 13.32 |
| sixth | pole hitting | 229.6 | 13.32 |
| embodiment | seam hitting | 228.9 | 13.25 |
| seventh | pole hitting | 228.5 | 13.18 |
| embodiment | seam hitting | 227.0 | 13.17 |
| eighth comparative | pole hitting | 227.5 | 13.92 |
| example | seam hitting | 223.6 | 13.45 |

Trajectory height means an angle of elevation viewed from a launching point of a golf ball to the highest point thereof in flight.

As is clear from Table 4, the golf balls of the first through seventh embodiment have smaller differences in the carry and the trajectory height between the pole hitting and the seam hitting than those of the eighth comparative example. As described previously, VS and VP were differentiated in the golf balls of the first through seventh embodiment. It was proved that in the golf balls of the comparative example 8 having S and P regions on the spherical surfaces thereof, the trajectory height was 0.47° more and the carry was 3.0m longer in the pole hitting than in the seam hitting.

As apparent from the foregoing description, the deviation of the golf ball of the present invention is small in putting because dimples are arranged symmetrically with respect to the face including the parting line.

According to the golf ball of the present invention, the difference in the dimple effect, between the region including the parting line having no dimples formed thereon and the other region, is reduced by making the volumes of dimples arranged within the region including the parting line larger than those of dimples arranged within the other region. Thus, the difference in the trajectory height between the pole hitting and seam hitting can be reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball comprising, a spherical surface, said surface having a great circle zone, a first and a second pole, said poles being formed by the intersection with said surface of a first axis passing through the center of the ball, and a parting line, said parting line being formed by the intersection of a plane passing through the center of the ball, said being perpendicular to said first axis and equidistant between said first and second poles, and being divided into an S region and a P region by a central angle of the sphere, said angle being measured from said plane toward said first axis and being less than 60°, said S region extending away from said parting line toward each said poles and said P region having a first portion and a second portion, said first portion extending from said first pole to said S region, said second portion extending from said second pole to said S region, said S region having a plurality of kinds of dimples $SD_n$, each of said plurality of kinds of S region dimples differing in curvature from every other of said plurality of kinds of S region dimples, said plurality of kinds of S region dimples being symmetrically arranged in relation to said parting line, wherein each of said plurality of kinds of S region dimples has a volume $VSD_n$, said P region having a plurality of kinds of P region dimples, $PD_n$, each of said plurality of P region dimples differing in curvature from every other of said plurality of kinds of P region dimples, said plurality of kinds of P region dimples being symmetrically arranged in relation to said parting line, wherein each of said plurality of kinds of P region dimples has a volume of $VPD_n$, and wherein at least one of said plurality of kinds of S region dimples has a corresponding one of said plurality of kinds of P region dimples having an equal curvature, the value of $VSD_n/VPD_n$ for each pair of corresponding dimples being set as $1.02 \leqq VS/VP \leqq 1.25$.

2. The golf ball as claimed in claim 1, wherein said central angle which separates said S region from said P region is $10° \leqq \theta < 60°$.

3. The golf ball as claimed in claim 1, wherein a dimple arranged within said S region having the same curvature as that of a corresponding dimple arranged within said P region has a depth and a diameter different therefrom.

4. The golf ball as claimed in claim 1, wherein said great circle zone is provided on said parting line.

* * * * *